United States Patent [19]

Brown et al.

[11] 4,372,091

[45] Feb. 8, 1983

[54] PRECAST CONCRETE STRUCTURAL UNIT AND COMPOSITE WALL STRUCTURE

[75] Inventors: William L. Brown, Avon, Conn.; Roger L. Toffolon, 1060 Prospect Ave., Hartford, Conn. 06105

[73] Assignees: Atlantic Pipe Corporation, Plainville, Conn.; Roger L. Toffolon, Stuart, Fla.

[21] Appl. No.: 204,327

[22] Filed: Nov. 4, 1980

Related U.S. Application Data

[63] Continuation-in-part of Ser. No. 968,476, Dec. 11, 1978, abandoned.

[51] Int. Cl.[3] ..... E04C 1/10

[52] U.S. Cl. ..... 52/593; 52/604

[58] Field of Search ..... 52/593, 595, 602–605, 52/404–407, 594, 284

[56] References Cited

U.S. PATENT DOCUMENTS

| | | | |
|---|---|---|---|
| 112,925 | 3/1871 | Johnson | 52/593 |
| 2,546,356 | 3/1951 | Boyd | 52/604 X |
| 2,703,487 | 3/1955 | Ossoinack | 52/594 |
| 2,880,470 | 4/1959 | Pickersgill | 52/603 |
| 3,422,588 | 1/1969 | Stewart | 52/595 |
| 3,478,482 | 11/1969 | Weir | 52/97 |
| 3,905,170 | 9/1975 | Huettemann | 52/593 |
| 4,067,166 | 1/1978 | Sheahan | 52/593 |
| 4,126,979 | 11/1978 | Hancock | 52/594 |

FOREIGN PATENT DOCUMENTS

| | | | |
|---|---|---|---|
| 2719107 | 11/1978 | Fed. Rep. of Germany | 52/593 |
| 528713 | 6/1955 | Italy | 52/594 |
| 536434 | 12/1940 | United Kingdom | 52/593 |
| 541853 | 12/1941 | United Kingdom | 52/595 |

*Primary Examiner*—J. Karl Bell

*Attorney, Agent, or Firm*—McCormick, Paulding & Huber

[57] ABSTRACT

Precast concrete structural units and composite wall structure comprising a plurality of the units stacked vertically in horizontal rows. Each unit comprises a pair of laterally spaced longitudinally extending side panels. A pair of laterally extending connecting arms are connected to or formed integrally with the panels at their respective inner surfaces whereby to secure the panels in relatively fixed position. A mortise-tendon connection between superposed units is provided with a vertically recessed mortise at the bottom of each connecting arm and a complementary vertically projecting tendon at the top of each arm. Each mortise and tendon defines a pair of laterally spaced oppositely facing generally vertical bearing surfaces and each mortise and tendon is approximately ⅓ the total width of the associated structural unit. Longitudinal spacing of connecting arms from each other is approximately twice the longitudinal spacing of each arm from the adjacent end of the side panels. Thus, the units may be stacked vertically in alignment or in horizontally staggered rows with horizontal displacement between units in adjacent rows approximately one half of the length of a unit. The connecting arms are thus aligned vertically to provide columnar openings which may be filled for added structural integrity of the wall and to provide a gravity wall. A composite wall may include rows of wider units at the bottom with rows of narrow units thereabove as well as a narrow-wider-narrower arrangement and conversion units may be employed at the interface between wider and narrower units. A bearing wall may include vertical tie rods and bearing pads or other material may be employed in joints between units. Filter and trim material may also be employed in bearing and other walls. A shingle effect may also be provided to conceal horizontal joint lines. Double mortise-tendon units, vertical partition means, hold-down slabs, L-shaped top units and other features are also disclosed.

59 Claims, 39 Drawing Figures

FIG. 1
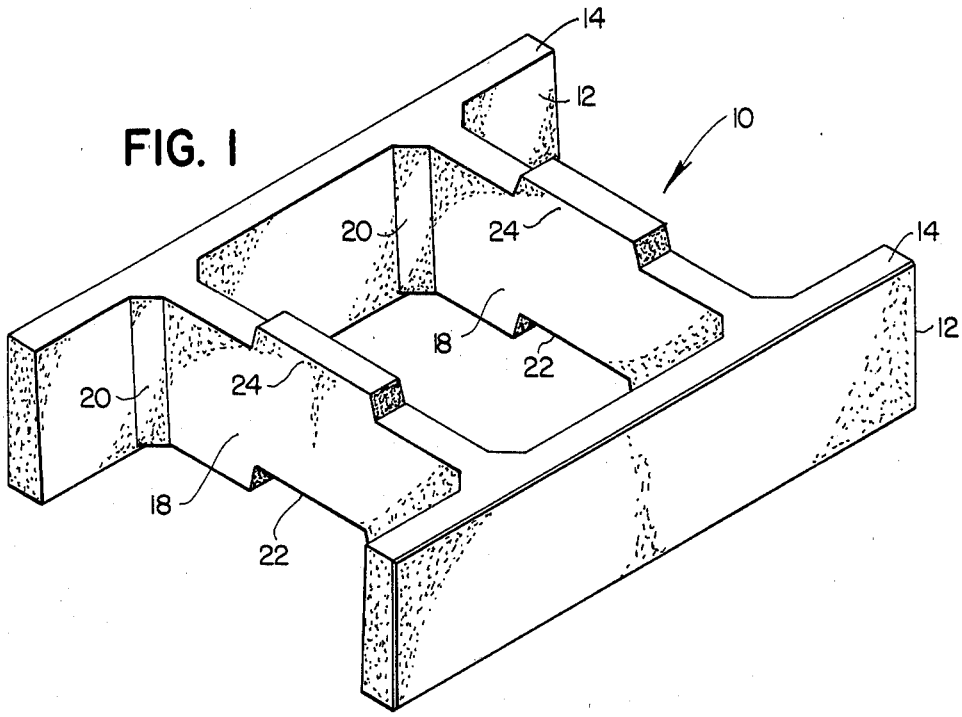
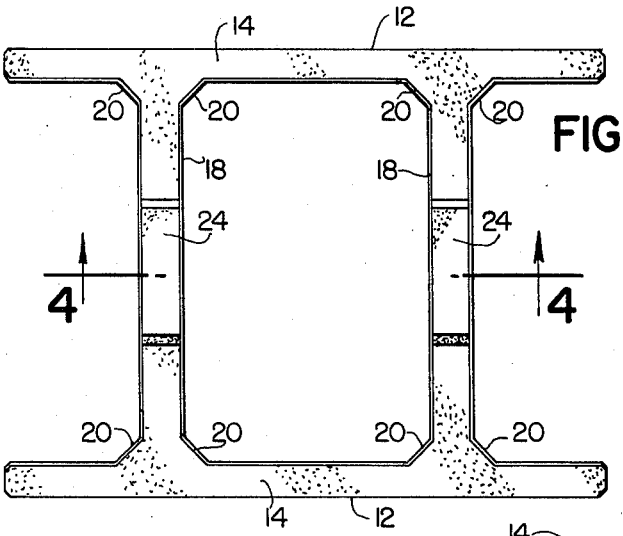
FIG. 2
FIG. 3
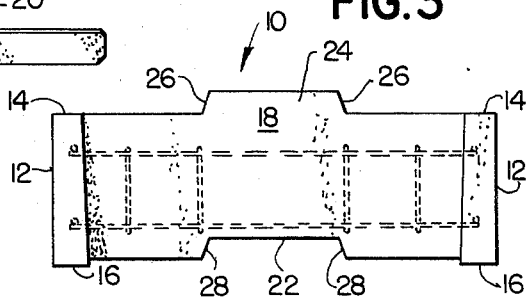
FIG. 4
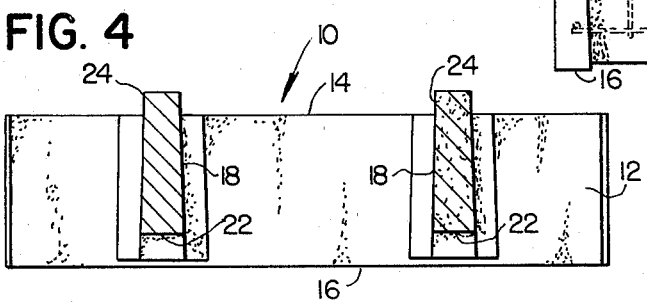

FIG. 5
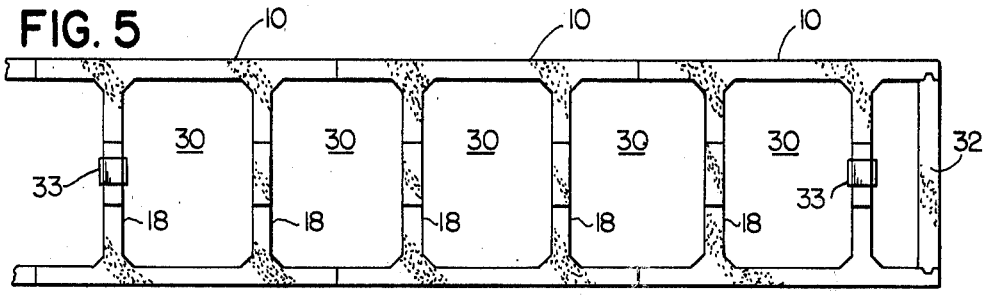
FIG. 6
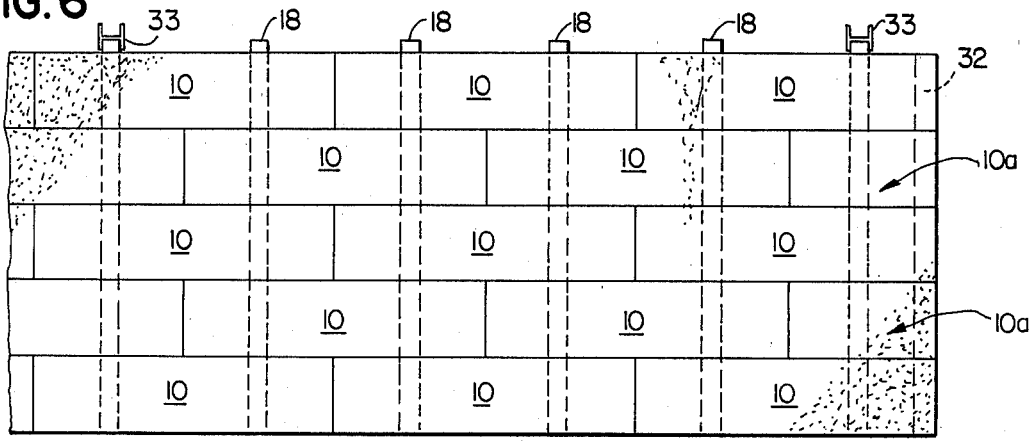
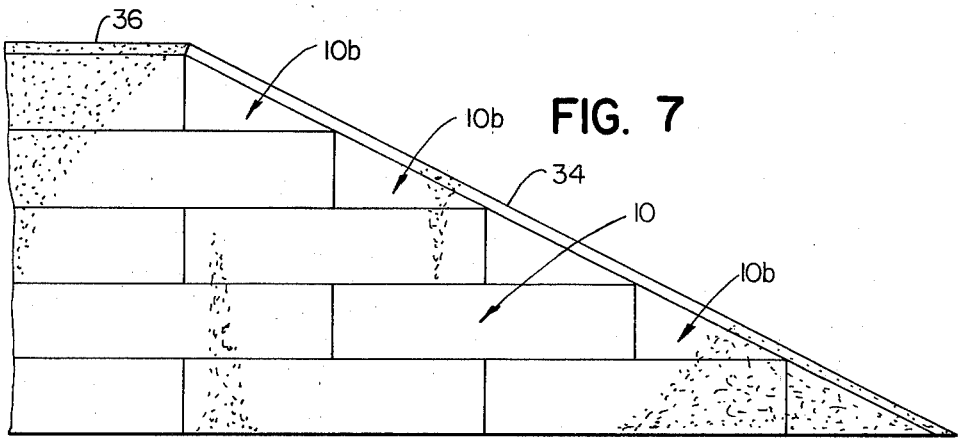
FIG. 7

FIG. 8
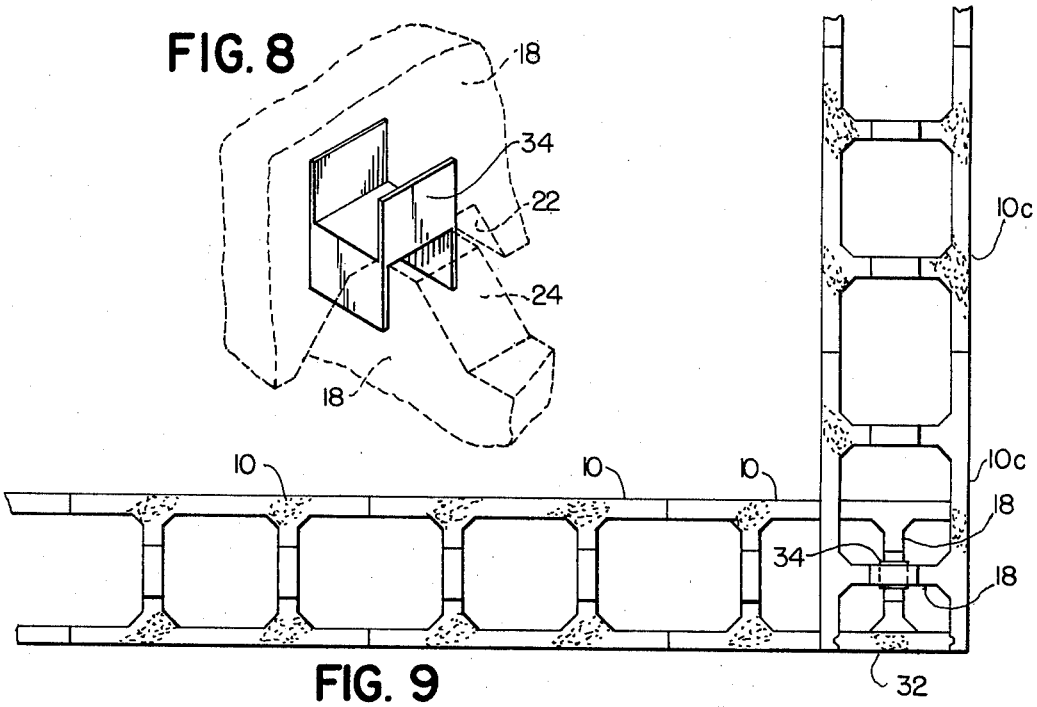
FIG. 9
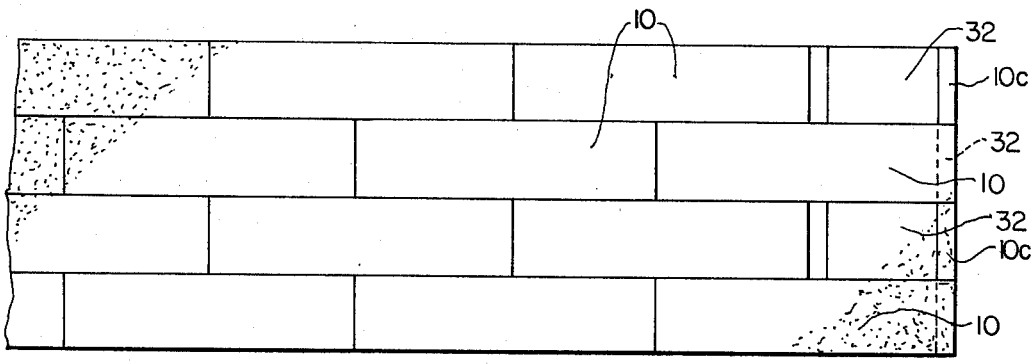
FIG. 10

PRECAST CONCRETE STRUCTURAL UNIT AND COMPOSITE WALL STRUCTURE

CROSS REFERENCE TO RELATED APPLICATION

This invention is a continuation-in-part of application Ser. No. 968,476, filed Dec. 11, 1978 now abandoned by the inventors herein and having the same title.

BACKGROUND OF THE INVENTION

This invention relates generally to precast concrete structural units for use in the construction of walls and the like in vertically stacked horizontal rows.

More particularly, the invention relates to an improved precast concrete structural unit of the general type shown in U.S. Pat. No. 3,877,236. The structural unit shown in this patent comprises a pair of spaced side panels and a laterally extending connecting arm for fixing the side panels in position. The units may be stacked one atop the other in staggered horizontal rows to form a wall. A lateral interlock means takes the form of depending marginal portions at lower edges of the panels which engage top edge portions of sub-adjacent units to secure the units against lateral displacement.

The units of the patent and composite wall structures constructed therewith are generally satisfactory. The structural integrity of the composite walls however, particularly in the case of retaining walls, may be inadequate in certain instances.

It is the general object of the present invention to provide an improved precast concrete structural unit of the type mentioned wherein the structural integrity of the individual unit is substantially improved with an attendant improvement in the structural integrity of a composite wall structure formed with a plurality of units stacked vertically in horizontal rows.

SUMMARY OF THE INVENTION

In fulfillment of the foregoing object, a precast concrete structural unit is formed with a pair of laterally spaced longitudinally extending and vertically disposed side panels. Each side panel has a generally rectangular configuration viewed laterally and each panel is of generally rectangular cross-sectional configuration with only a slight inclination of its vertical walls as for example for mold clearance. At the top of each panel, a planar substantially horizontal and longitudinally extending top surface is provided and a similar and parallel bottom surface is also provided on each panel.

In accordance with the invention at least one vertically disposed generally rectangular and laterally extending connecting arm is connected with or formed integrally with the panels at respective inner surfaces thereof whereby to secure the panels in relatively fixed position. Preferably, and as will be described, two connecting arms are provided in longitudinally spaced relationship between the side panels.

Further, in accordance with the present invention, each connecting arm includes mating vertically projecting and vertically recessed lateral interlock means integral with the arm and arranged in top and bottom vertically opposite relationship. The interlock means include at least two complementary generally vertical bearing surfaces adapted for pressure engagement such that the bottom lateral interlock means on a connecting arm serves cooperatively with a top interlock means on a connecting arm of an immediately sub-adjacent precast unit to laterally interlock two superposed units.

The lateral interlock means are gravity dependent with the deposition of one unit on top another necessary for the engagement of the interlock. However, the interlock means are physically positive laterally with the respective generally vertical complementary bearing surfaces of the bottom and top interlock means of superposed units in pressure engagement. Further, the planar top and bottom panel surfaces are interengaged in superposed units but provide lateral restraint only through gravity derived frictional forces. No interengaging bearing surfaces provide lateral restraint between superposed panels.

As will be explained more fully hereinbelow the arrangement of lateral interlock means solely on connecting arms with bearing surfaces operative only between superposed connecting arms and with no lateral restraint other than gravity derived frictional forces acting between superposed panels results in greatly improved structural integrity of the units. The strength of the units is found to be as much as 100% higher than that of the units in the above mentioned patent and, in certain instances even greater strength improvement is anticipated.

More particularly, and with regard to the improved lateral interlock means, the connecting arms are provided with mortise-tendon connections with a vertically recessed mortise and a complementary vertically projecting tendon arranged in vertically opposite relationship on the arm. Preferably, the mortise is located at the bottom of each arm and the tendon projects upwardly from the top of the arm and two pairs of generally vertical bearing surfaces are defined respectively at the sides of the mortise and tendon.

Further, the bearing surfaces are preferably inclined slightly from the vertical in a direction upwardly and inwardly toward the lateral center-line of the associated connecting arm. Still further, the mortise and tendon preferably each have a width less than $\frac{3}{4}$ the width of the unit whereby to locate the bearing surfaces substantially laterally inwardly from the side panels toward the center line of the connecting arms. In the presently preferred form each mortise and tendon is approximately $\frac{1}{3}$ the total width of the structural unit and excellent strength characteristics have been achieved.

In accordance with another aspect of the invention, connecting arms are spaced longitudinally from each other approximately twice the longitudinal spacing of each arm from the adjacent end of the side panels. The structural units may thus be adapted for vertical alignment of the connecting arms when the units are stacked in vertical alignment or in horizontally staggered rows with the horizontal displacement of units in adjacent rows approximately one half of the length of a unit. This results in interior columnar openings which are continuous vertically and which are adapted for the receipt of fill material. With fill material deposited in the columnar openings in a composite wall formed from a plurality of structural units, integral vertical columns of fill material result within the walls and enhanced overall structural integrity and stability of the wall is achieved. More particularly, the wall becomes a "gravity wall" in the respect that gravity tends to offset forces applied from the rear of the wall by fill or other material therebehind. Inclined side surfaces of the arms and panels as well as upwardly facing horizontal surfaces are engaged by the fill and tests have indicated that as much as 80% of the weight of the fill in the wall cavities effectively becomes part of the wall.

As will be described more fully, the structural units of the invention are also particularly well adapted to use in the construction of composite walls which may serve other purposes such as bearing walls as in the support of bridge structures and the like.

BRIEF DESCRIPTION OF THE DRAWINGS

FIG. 1 is a perspective view of an improved precast concrete structural unit constructed in accordance with the present invention.

FIG. 2 is a top view of a precast concrete structural unit of FIG. 1.

FIG. 3 is an end view of the structural units of FIGS. 1 and 2.

FIG. 4 is a vertical section taken generally as indicated at 4—4 in FIG. 2.

FIG. 5 is a top view of a portion of a composite wall structure formed with a plurality of precast concrete structural units of FIG. 1 through 4.

FIG. 6 is a front view of the wall structure of FIG. 5.

FIG. 7 is a front view of a portion of a wall structure similar to FIG. 6, but an alternative form of an end portion of the wall which includes gradually downwardly from top to bottom.

FIG. 8 is a perspective view showing a small bracket for interconnecting adjacent arms of structural units at the corner of a composite wall structure having right angular configuration.

FIG. 9 is a top view of a wall having a right angular configuration and employing a bracket of FIG. 8.

FIG. 10 is a front view of the wall of FIG. 9.

PREFERRED EMBODIMENTS

Figure 11:
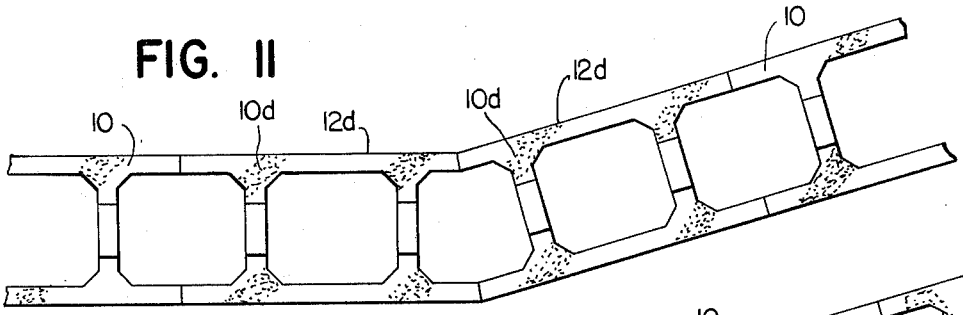
FIG. 11 is a top view of a wall constructed from the improved structure units and including a gradual angular change in direction.

Referring particularly to FIGS. 1 through 4, it will be observed that a precast structural unit indicated generally at 10 comprises a pair of laterally spaced longitudinally extending and vertically disposed side panels 12, 12. Each of the panels 12, 12 is of generally rectangular configuration viewed laterally and of a generally rectangular cross-sectional configuration. Substantial upward and inward inclination of side surfaces or slight clearance angles merely for mold removal may be provided as illustrated in FIG. 3. Further, sharp corners may be rounded or angled to facilitate casting and to prevent corner breakage.

At the top of each panel 12 a surface 14 is substantially planar and uniform and resides in a substantially horizontal and longitudinally extending plane. Similar surfaces 16, 16 are provided at the bottom of each of the panels 12, 12.

In accordance with the present invention, the panels 12, 12 have at least one vertically disposed generally rectangular and laterally extending connecting arm joining the panels together. As shown, and as presently preferred, the precast structural units 10, 10 each have two similar laterally extending connecting arms 18, 18 and each arm is formed integrally at each end with a panel 12. Further, fillets 20, 20 are preferably formed at the junction of the connecting arms 18, 18 and the panels 12, 12 for added strength.

Further, in accordance with the invention, each of the connecting arms 18, 18 includes mating vertically projecting and vertically recessed lateral interlock means integral with the arm and arranged in top and bottom vertically opposite relationship on the arm. The interlock means includes at least two complementary generally vertical bearing surfaces adapted for pressure engagement, and as will be seen hereinbelow, the bottom lateral interlock means on a connecting arm serves cooperatively with a top interlock means on a sub-adjacent connecting arm to laterally interlock two superposed structural units.

Still further, it is preferred in the basic units that each mortise and tendon be approximately centered laterally on its connecting arm 18 and the width of the mortises and tendons should be such that the bearing surfaces defined thereby are spaced substantially laterally inwardly from the side panels 12, 12 and toward the center line of the connecting arms. The width of the mortises and tendons should preferably be less than ¾ the width of the unit, and as shown and presently preferred, each mortise and tendon 22, 24 has a width approximately ⅓ the total width of the structural unit 10. Excellent strength characteristics of the structural units have been achieved with the mortises and tendon configurations and dimensions shown.

Further in accordance with the presently preferred form of the invention the connecting arms 18, 18 of the units 10, 10 are spaced apart longitudinally from each other so as to align vertically when the units 10, 10 are stacked vertically with adjacent horizontal rows of units staggered vertically. That is, the unit 10 shown has connecting arms 18, 18 spaced longitudinally approximately twice the longitudinal spacing of each arm from the adjacent end of the side panels 12, 12. The unit 10 is thus adapted for vertical alignment of connecting arms when units 10, 10 are stacked vertically in alignment or in horizontally staggered rows with horizontal displacement between units in adjacent rows approximately one half of the length of the unit. Thus, units 10, 10 in FIGS. 5 and 6 are stacked vertically in horizontal rows staggered one half a unit length and the connecting arms 18, 18 align vertically as shown by broken line in FIG. 6.

Vertical alignment of the connecting arms 18, 18 as described is important in the provision of vertically extending interior columnar openings 30, 30 which are adapted to receive fill material in a composite wall structure as in FIGS. 5 and 6. With vertically continuous or columnar openings such as 30, 30 the fill material adds integrated characteristics to the overall strength of the composite wall. Obviously, the fill material may be compacted if desired and various types of fill material may be employed as dictated by the requirements of a given installation. The fill also provides "gravity wall" characteristics as described above with the inclined side surfaces of the units frictionally engaged by the fill.

As will be apparent from FIGS. 5 and 6, the end of a composite wall formed by vertically stacking units 10, 10 may employ half units such as **10*a* in alternate rows. Further, in order to close the ends of the units 10 and 10*a*, vertical inserts or slabs 32, 32 may be provided. Still further H shaped members may be employed intermittently as at 33, 33 for longitudinally locking superposed units. Alternatively, when it is desired to provide an inclined end surface of a composite wall as in FIG. 7, special triangular units 10*b*, 10*b* may be provided and a top member in the form of a slab or slabs 34, 34 may be provided to close the openings at the end of the wall. Similarly, a cap 36 may be provided along the top of the wall. The caps or slabs 34 and 36** may of course be constructed sectionally employing precast slab sections.

In FIGS. 9 and 10 the manner in which a composite wall structure may be formed with the units 10, 10 is illustrated in a right angular configuration, that is, the units 10, 10 are adapted for a right angle or 90° turn by arranging an end unit **10*c* at right angles in a second row or course above a first unit 10. An insert as in FIGS. 5 and 6 is employed and the cross or connecting arms 18, 18 of the units 10, 10*c* are preferably connected together by a bracket 34, FIG. 8. The bracket 34 has right angularly directed U-shaped sections respectively for fitting the tendon 24 of a lower unit 10 and the mortise 22 of an upper unit 10*c*. Obviously, alternate rows or courses of units 10, 10*c* may be arranged at right angles and brackets such as 34 may be employed in each instance to secure vertically adjacent units 10, 10*c***.

Figure 12:
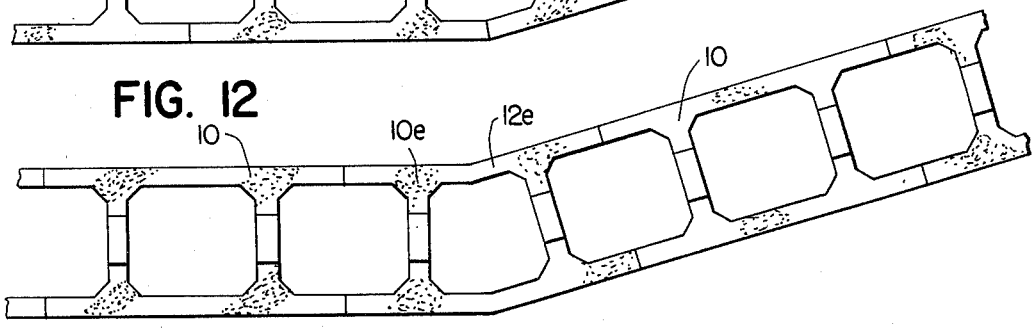
FIG. 12 is a second embodiment of the FIG. 11 composite wall.
Figure 13:
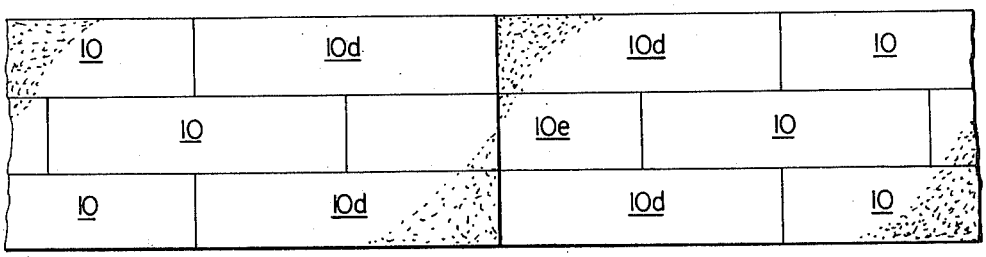
FIG. 13 is a front view of the FIG. 11 and/or 12 composite wall.

In FIGS. 11, 12 and 13, special units are shown for constructing a composite wall with angularly related sections at angles less than 90°. In the first row or course of units 10, 10 in FIG. 13, precast units **10*d*, 10*d* have rear panels 12*d*, 12*d*, FIG. 11, which are somewhat shortened to provide for the angular relationship of the wall sections. In the second row or course of units in FIG. 13, the precast unit 10*e* has front and rear panels 12*e*, 12*e*, FIG. 12, each having first and second angularly related portions complementary to the angles formed by the two panels 12, 12*d* in FIG. 11. The third row or course of units 10, 10*d* in FIG. 13 reverts to the arrangement of the first row and the fourth row may correspond to the second row 10, 10*e*** of the precast units.

Figure 14:
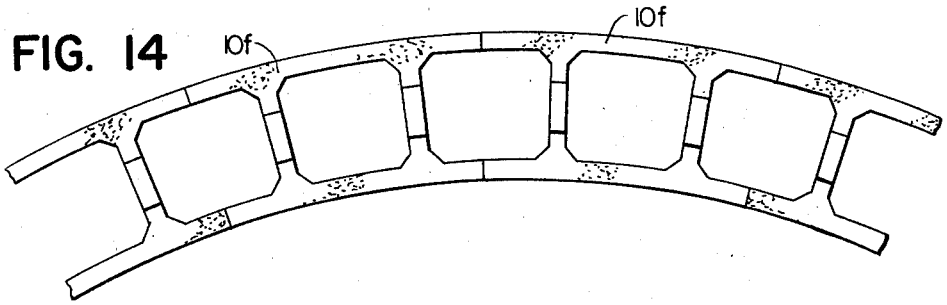
FIG. 14 is a top view of an arcuate composite wall construction with slightly modified precast concrete structural units in accordance with the invention.
Figure 15:
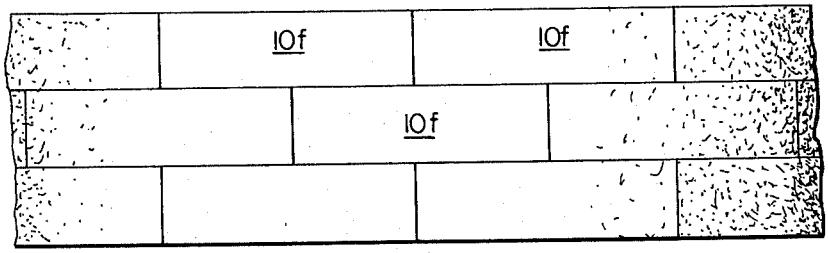
FIG. 15 is a front view of the FIG. 14 wall.

In FIGS. 14 and 15, units **10*f*, 10*f*** take a gradual arcuate configuration viewed from above. Obviously, the arc may vary as desired and the units may be employed in constructing arcuate sections of composite walls or, alternatively, the units may be continued in the arcuate arrangement to form full circle or silo type structures.

Figure 16:
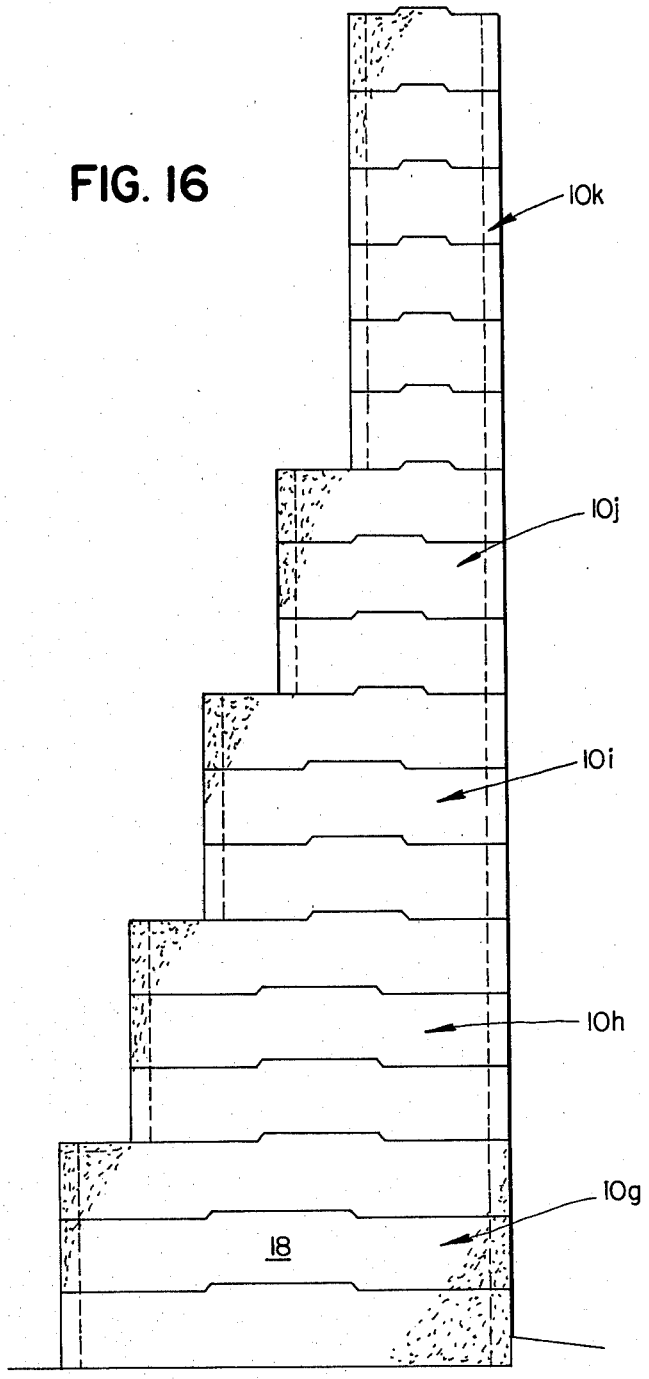
FIG. 16 is a side view of a composite wall structure including several sections with structural units of varying width and with conversion or transition units at the interface between units of different widths.

In FIG. 16, variations in the construction of the precast units are illustrated and it will be observed that panel size may be maintained similar with cross or connecting arms varying in length to provide units of various width. It will also be obvious that side panel size may be varied as desired. In the composite wall structure of FIG. 16 the widest precast units **10*g* are arranged in three lowermost rows with the third row comprising units 10*g* which may be referred to as conversion or transition units. The lateral positioning of the tendons at the tops of the cross arms 18 in this row are such as to correspond to the like positioning of the mortises in the units 10*h* thereabove. Similarly with regard to the uppermost units 10*h* wherein the tendons are positioned laterally to correspond to the mortises of the rows of units 10*i*. The uppermost unit 10*i* illustrated is also a conversion or transition unit as is the uppermost unit 10*j***. Obviously, many variations of units can be employed in combination in accordance with requirements of a given installation as to wall height, forces to be exerted on the left hand side of the wall assuming that the wall is used as a retaining wall with the right hand side of the wall exposed, and other variables. The flush right hand front face of the wall may also be stepped back as by omitting transition units and plantings may be provided in the stepped back portions.

Figure 17:
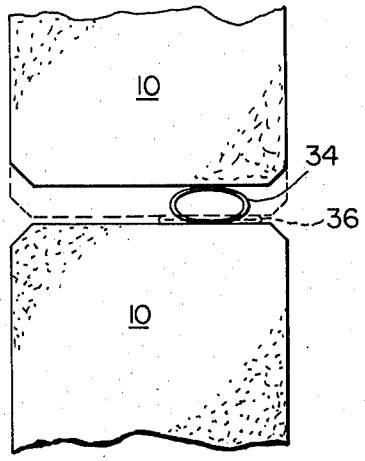
FIG. 17 is a fragmentary enlarged view showing portions of superposed precast structural units with a tubular filter element therebetween.

FIGS. 17 through 22 illustrate joint treatment and in each instance, the joints illustrated may be regarded as either horizontal or vertical joints between precast units 10, 10. FIG. 17 illustrates a closed cell neoprene sponge material in tubular form which may be disposed between vertically adjacent units and compressed as illustrated from its full line form 34 to broken line form 36. The filter material serves to prevent "fines" or fine fill material in the interior of the units forming a wall from passing outwardly with water or other liquids at the joint areas and causing stains of the front surfaces of the units.

Figure 18:
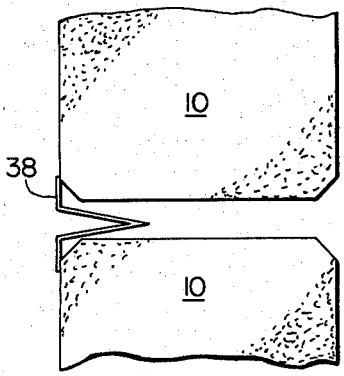
FIG. 18 is a fragmentary enlarged view showing portions of superposed precast structural units with a tubular trim element therebetween.

In FIG. 18 a trim member 38 is illustrated between vertically adjacent units and is adapted particularly for horizontal joints. Any slight roughness or uneveness at the joint area will be concealed by the trim member 38 with the units in place. The trim member 38 has a general T configuration with a V-shaped body portion which is captured between the units 10, 10 and compressed to secure the trim member in position when the units are moved into engagement with each other.

Figure 19:
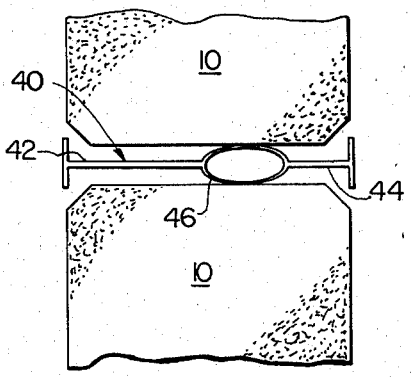
FIG. 19 is a fragmentary enlarged view showing portions of superposed precast structural units with a tubular composite filter and trim element therebetween.

FIG. 19 illustrates a composite filter and trim member. The member 40 includes trim portions 42 and 44, both generally T-shaped, and a tubular filter member 46. With the member 46 captured between units 10, 10 the filtering function as well as the trim function is achieved simultaneously.

Figure 20:
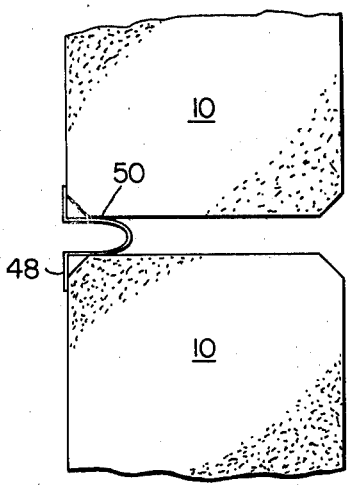
FIG. 20 is a fragmentary enlarged view showing portions of superposed precast structural units with a U-shaped trim element therebetween.

In FIG. 20 a trim member similar to the trim member 38 is illustrated at 48 and takes a generally T-shape with a U-shaped body portion. The U-shaped body portion is captured between the units 10, 10 and when compressed, fixes the trim member in position with the arms of the member concealing the joint between units.

Figure 21:
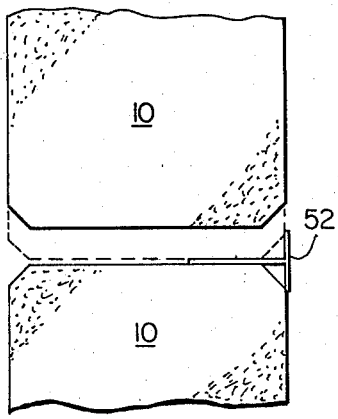
FIG. 21 is a fragmentary enlarged view showing portions of superposed precast structural units with a T-shaped trim element therebetween.

In FIG. 21 a simple T-shaped member 52 is captured between units 10, 10 to provide a trimming function only.

Figure 22:
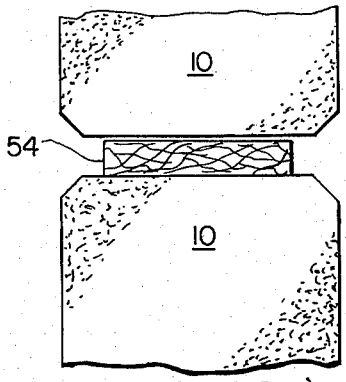
FIG. 22 is a fragmentary enlarged view showing portions of superposed precast structural units with a bearing element therebetween.

In FIG. 22 a bearing member 54 is provided at the joint between units 10, 10. The member 54 is normally employed in a composite wall structure wherein the wall serves as a bearing wall where it is desireable or necessary to provide for uniformity of bearing loads between the units 10, 10. With the bearing member disposed in the joint, bearing loads are distributed substantially uniformly from one unit 10 to another despite any slight nonuniformity or irregularity in the surfaces of the units. Bearing members presently preferred comprise cork and an asphalt impregnated felt member disposed in joint areas and thereafter held in place when the joints are placed atop one another.

Figure 23:
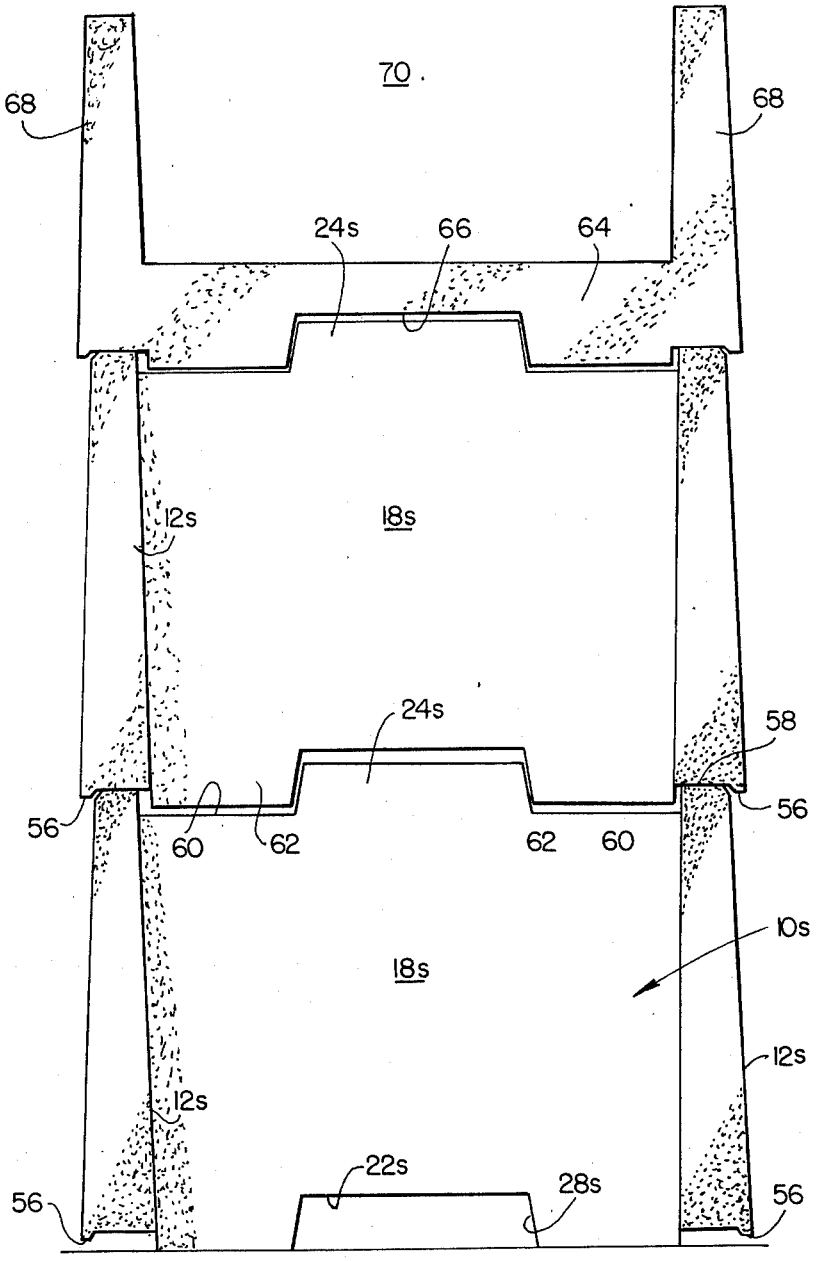
FIG. 23 is an end view of a composite wall structure formed with precast concrete structural units of a modified construction.

In FIG. 23, a further embodiment of the improved precast concrete structural unit of the present invention is illustrated at **10*s*. Units 10*s*, 10*s* illustrated form a two row or two course composite wall viewed from the end and each of the units comprises spaced apart panels 12*s*, 12*s* and a pair of connecting arms 18*s*, 18*s*, one shown. Each connecting arm 18*s* has a mortise 22*s* at a lower portion and a tendon 24*s* at an upper portion thereof. All other portions of the units are substantially the same as those described for FIGS. 1 through 4 except for the provision of a shingled exterior effect provided by small depending flanges 56, 56. The flanges 56, 56 are formed at lower edge portions of the side panels 12*s*, 12*s* and as illustrated at the junction at the lower and upper units 10*s*, 10*s* the lower edges of the flanges 56, 56 overlap and conceal the joint areas 58, 58 between the units 10*s*, 10*s*. It should be noted that the lateral dimensions and tolerances between inner edges of the depending flanges 56, 56 are so related to the lateral dimensions and tolerances of the mortises 22*s*, 22*s* and the tendons 24*s*, 24*s* that the bearing surfaces 26*s*, 28*s* always engage prior to engagement of a flange 56 with a top edge of a sub-adjacent panel. Thus excessive lateral displacement of units 10*s*, 10*s* relative to each other as might damage or break the flanges 56, 56** is avoided.

Further, the units **10*s*, 10*s* are constructed with connecting arms 18*s*, 18*s* projecting downwardly beneath the bottom surfaces of the side panels 12*s*, 12*s*. Thus, the flanges 56, 56 are protected as illustrated in the case of the flanges 56, 56 of the lowermost units 10*s*. When the units 10*s*, 10*s*** are transported damage to the flanges is thus avoided.

Further, and in order that the units may properly nest in stacked relationship, the upper portions of the connecting arms **18*s*, 18*s* adjacent tendons 24*s*, 24*s* are recessed vertically to receive the downwardly projecting lower portion of the arms when the units are in stacked relationship. Thus, the recessed portions 60, 60 of the arm 18*s* receive the downwardly projecting portions 62, 62 of the arm 18*s* thereabove with the units 10*s*, 10*s*** stacked as illustrated.

Various types of caps, slabs etc. may obviously be provided at the tops of the composite wall structures formed with the precast units of the present invention. In FIG. 23 a precast unit is provided which may be employed in planting shubbery, etc. for beautification of a top surface of a wall. The unit 64 may be precast with a mortise 66 to receive the tendons **24*s* of the uppermost connecting arms 18*s* and of similar arms therebehind. Side walls 68, 68 define a trough or planting bed 70** which may be filled with appropriate material for the planting of shrubs, flowers, etc.

Figure 24:
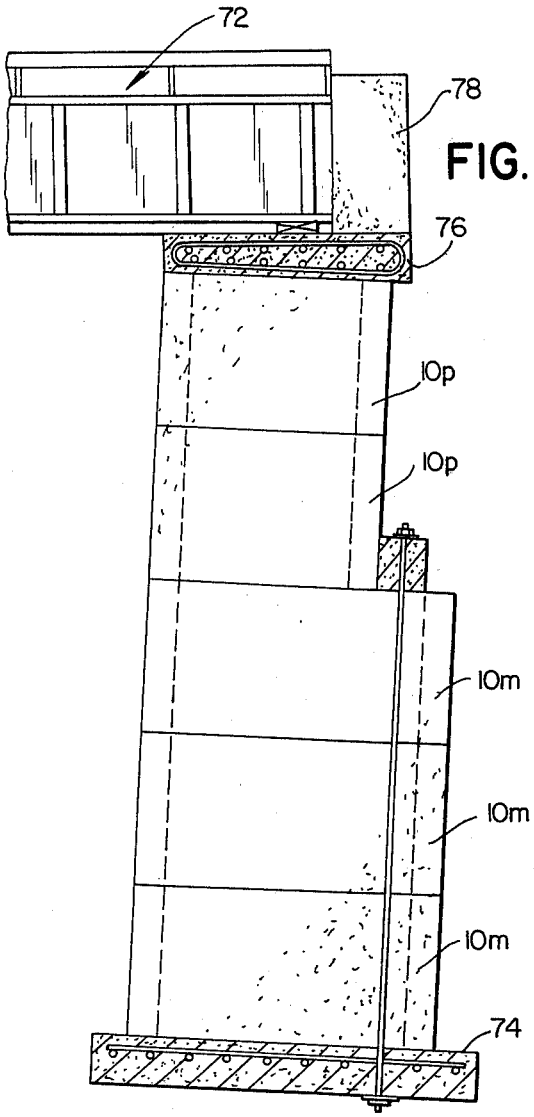
FIG. 24 is an end view of a composite wall structure employed as a bearing wall for a bridge structure.
Figure 25:
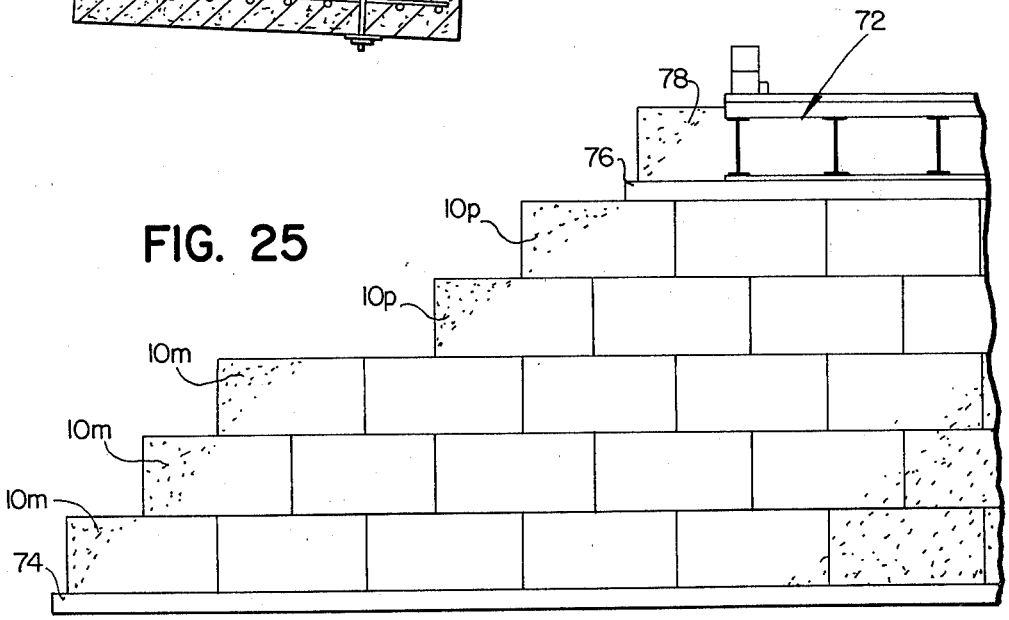
FIG. 25 is a front view of the composite wall structure of FIG. 24.

FIGS. 24 and 25 illustrate the use of improved precast structural units of the present invention in a bearing wall which serves as a bridge abutment. Three (3) rows or courses of units **10*m*, 10*m* are somewhat wider than (2) rows or courses of units 10*p*, 10*p* thereabove. The uppermost unit 10*m* shown may be a conversion or transition unit as in FIG. 16. The units 10*m* and 10*p* are stacked vertically and in staggered horizontal rows as illustrated in FIG. 25 to support a bridge structure indicated generally at 72 in FIGS. 24 and 25. Base or foundation slabs or slab means 74 may comprise sectionalized precast slabs, and a top or bearing slab 76 may be of similar construction. Preferably, upstanding precast concrete blocks 78 are also provided for support of bridge structure 72 and it will be apparent that the slab 76 may be notched or mortised as required to receive tendons along the arms of the uppermost row of the units 10*p*, 10*p***.

Preferably, the three rows of structural units **10*m*, 10*m* are secured in position as shown by employing tie rods 80, 80 which extend vertically through the slabs 74, 74 upwardly through the units 10*m*, 10*m* and engage a horizontally extending beam 82. The beam 82 may comprise precast sections atop rear portions of the units 10*m*, 10*m* and the tie rods may be of conventional construction entered in precast openings in the slabs 74, 74 and beam 82. The composite wall structure is preferably inclined slightly from the vertical when employed as a bearing wall as in the bridge abutment shown with retained material on the right hand side of the wall. The angle of inclination may vary but is preferably a a few degrees. Further, the joints between units 10***m*, 10*m* preferably include the compressable bearing material mentioned above for distribution of loading effect substantially uniformly throughout the joint area.

Figure 26:
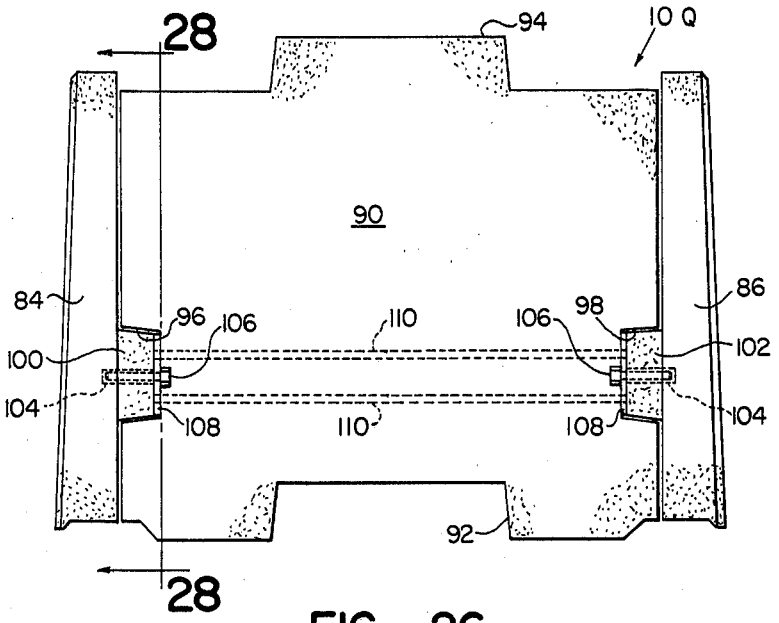
FIG. 26 is an end view of an alternative form of structural unit of the invention.
Figure 27:
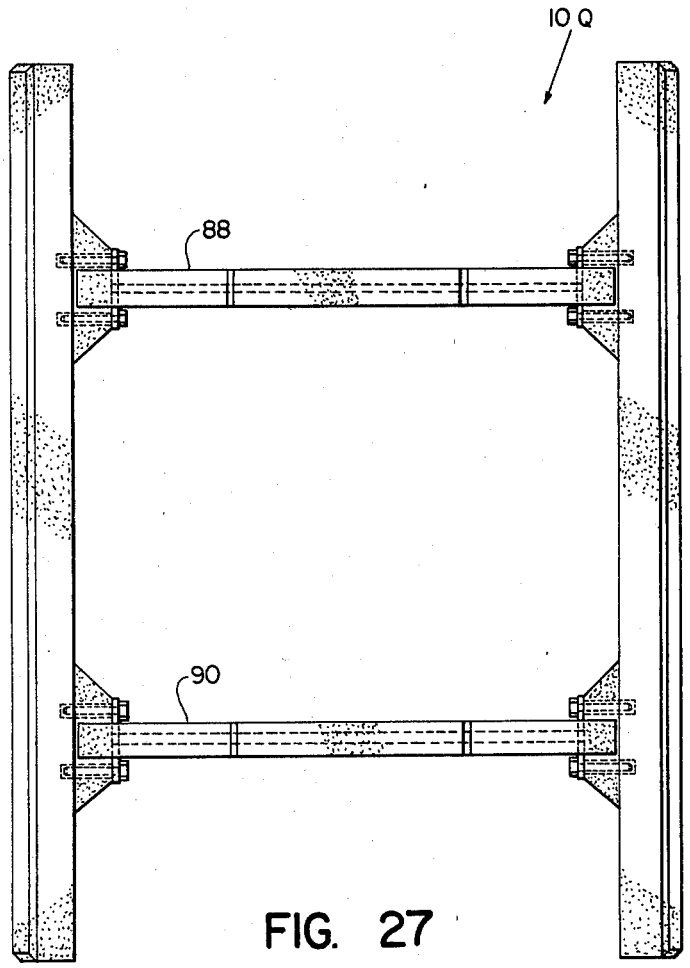
FIG. 27 is a top view of the structural unit of FIG. 26.
Figure 28:
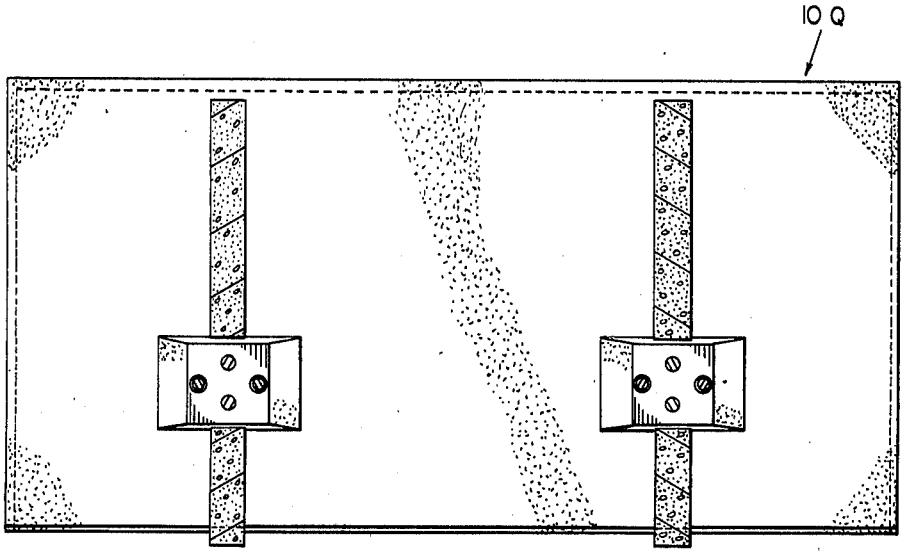
FIG. 28 is a vertical section taken generally as indicated at 28–28 in FIG. 26.

Referring now to FIGS. 26–28, a further embodiment of a precast structural unit is illustrated wherein side panels and connecting arms are of precast construction but separate elements, and wherein connecting means are provided and serve to secure the panels and arms in assembly and in the arrangement described above.

Opposing side panels 84, 84 are substantially indentical and spaced apart in parallel relationship with connecting arms 88, 90 extending laterally therebetween. The overall arrangement of elements is thus substantially identical with that described above but the panels and arms are precast as separate and individual elements and thereafter connected together in assembly as illustrated. Mortises 92 and tendons 94 are also substantially as described above and serve like functions.

Connecting means for the panels and arms preferably take the form of four (4) discrete connecting means operable respectively at the four (4) panel and connecting arm junctions to secure the panels and arms in assembly. As shown, the four (4) connecting means comprise interengaging threaded elements respectively associated with the panels and arms at the panel-arm junctions and, further, a lug-notch vertical interlock is also provided. Thus, notches 96, 98 in the arm 94 in FIG. 26 respectively receive lugs 100, 102 formed in the panels 84, 86. Internally threaded female inserts 104, 104, two in each lug, receive externally threaded bolts 106, 106. The bolts 106, 106 also have an associated attachment plate 108 and extend through suitable openings therein. Each attachment plate 108 is secured to an arm and, more particularly, is secured at the base portion of a notch 96 and extends thereacross with projecting opposite sides thereof approximately at right angles to the arm side surfaces, FIG. 27. Further, it is the presently preferred practice to secure the attachment plates 108, 108 by means of reinforcing members such as 110, 110 in the body of the arm and extending along the length thereof between the attachment plates 108, 108.

The structural unit in FIGS. 26–28 has the advantage of ease and convenience in production and can be produced at economic advantage. Nevertheless, the improved strength and other characteristics mentioned above are retained.

Figure 29:
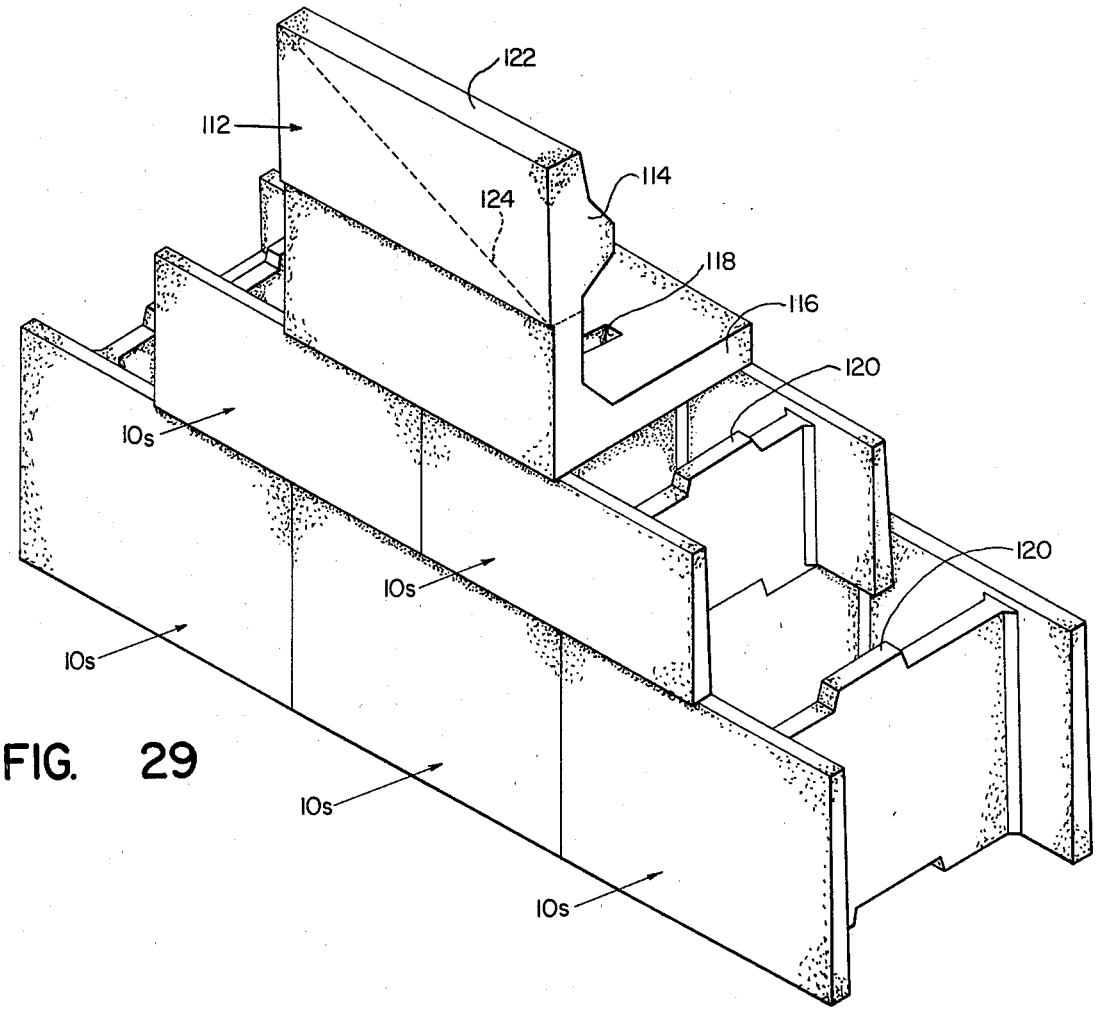
FIG. 29 is a somewhat schematic perspective view of a further composite wall structure with a generally L-shaped unit at the top.

FIG. 29 illustrates in fragmentary perspective a retaining or other wall constructed with structural units of the 10*s* type illustrated in FIG. 23. A first row or course of units 10*s* is substantially wider than a second row 10*s* thereabove and a generally L-shaped structural concrete unit 112 is shown atop the units 10*s*, 10*s* in the second row. As shown, the L-shaped unit 112 has generally vertical and horizontally projecting arms 114, 116 with the former projecting upwardly from and lying substantially in the plane of one side of the wall. A mortise 118 in the form of a through slot is provided in the horizontal arm 166 for receiving a tendon such as 120 on an arm of a unit 10*s* in the second or uppermost horizontal row of structural units. Additional suitably spaced mortises such as 118 may of course be provided.

As will be apparent, L-shaped units 112, 112 can be employed as an uppermost or finishing horizontal row of units in a retaining or other wall. Fill may be deposited atop the arms 116 of such units as well as within the openings in the wall proper between the connecting arms of the units 10*s*, 10*s*. Substantial savings in concrete are realized with the L-shaped units 112 and, additionally, the uppermost surfaces thereof such as the surfaces 122 may be inclined or otherwise shaped to provide for conformity with land contours and the like. Broken line 124 illustrates one possible inclination of an upper surface of an L-shaped unit and it will of course be understood that adjacent units may be contoured or shaped as required. Such shaping and contouring is much more readily accomplished with the L-shaped units 112 than with the structural units 10*s*.

Figure 30:
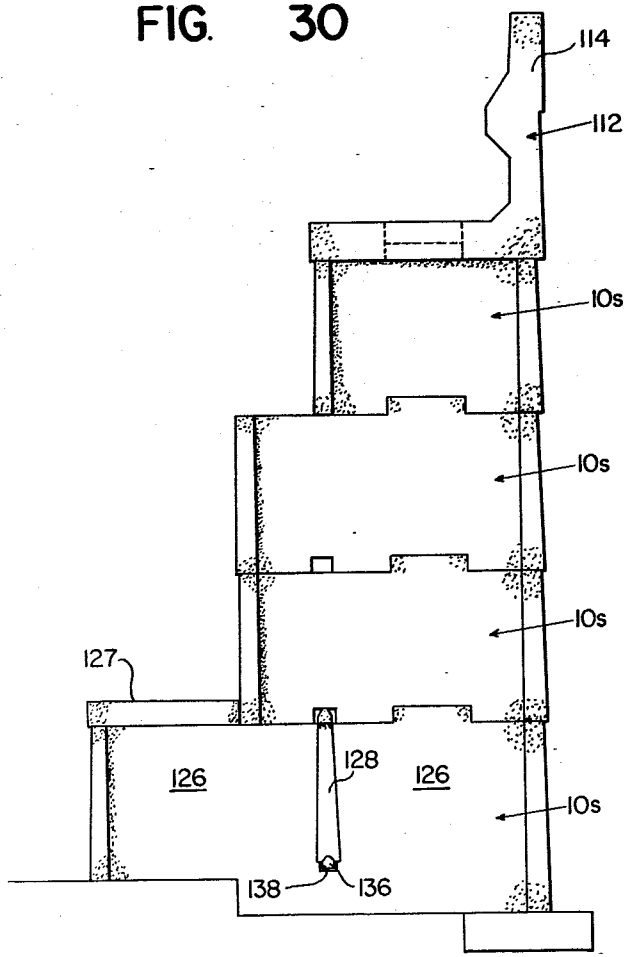
FIG. 30 is a somewhat schematic side elevation of a further composite wall structure with an L-shaped unit at the top and a horizontal closure means associated with a lowermost row of structural units.

FIG. 30 illustrates in cross section similar to the wall of FIG. 29 but including a first horizontal row of units 10*s* of substantial width or depth, second and third rows of units 10*s*, somewhat narrower and a fourth row of units 10*s* still narrower so as to provide a wider to narrower progression when the wall is viewed from bottom to top. This represents an efficient wall construction with regard to strength characteristics and savings in concrete. A row of L-shaped units 112 at the top provides a further savings in concrete and serves as a finish row or course as described. Further, it should be observed that the vertical arm 114 of the L-shaped unit 112 shown can serve as a portion of a parapet and as a vehicle deflection barrier as in road or highway construction where the road or highway extends leftwardly from the arm and the wall serves as a retaining wall beneath the road or highway.

Still with regard to FIG. 30, it will be noted that the widest or lowermost row of units 10*s* includes a vertical partition means which provides bins or fill receiving cavities of desired size between arms of the units 10*s* and frontwardly and rearwardly thereof. With the wider units 10*s* such as in the lowermost row of FIG. 30, the fill receiving cavities or bins may otherwise be somewhat oversize and ineffective in the downward retention of the units. That is, fill within the cavities works frictionally against the slightly inclined surfaces of the partition means and the arms, panels etc. to provide a hold-down force on the units as aforesaid and to provide a "gravity wall".

Partition means such as the unit 128 in FIG. 30 may of course vary widely in configuration and construction but, preferably, a precast drop-in unit is employed to substantially fit in the space between arms of the units 10*s*. FIG. 32 illustrates a typical drop-in unit with slightly inclined opposite surfaces 130, 130 for the hold-down function mentioned above and with oppositely projecting supporting wings 132, 132 at upper portions for engagement with and vertical support by top surfaces on the arms of the units such as 10*s*. A generally V-shaped upper surface 134 on the unit at the top portion thereof has a generally complementary V-shaped notch at a bottom portion of the unit. As illustrated in FIG. 30 a small V-shaped insert 136 is fixed in a notch 138 in arms of the units 10*s* and enters and engages the notch 136 to secure the drop-in unit 128 against sideways movement at its lower portion. Similarly in FIG. 31, a small insert 136 secures a lower portion of a drop-in unit 128 in a lowermost row of units 10*s*. At a top portion of the unit 128, the generally V-shaped surfaces thereof enter a notch 136 in a second drop-in unit 128 and secure the said unit against sideways movement. Still further, an upper portion of the second unit 128 secures a lower portion of the third drop-in unit 128 thereabove. As best illustrated at an upper portion of the third drop-in unit a notch 138 receives the wings 132, 132 of the uppermost drop-in unit 128 for support of the unit by the wings atop the upper surfaces of the arms of the units 10*s* in the third row or course of units.

Figure 31:
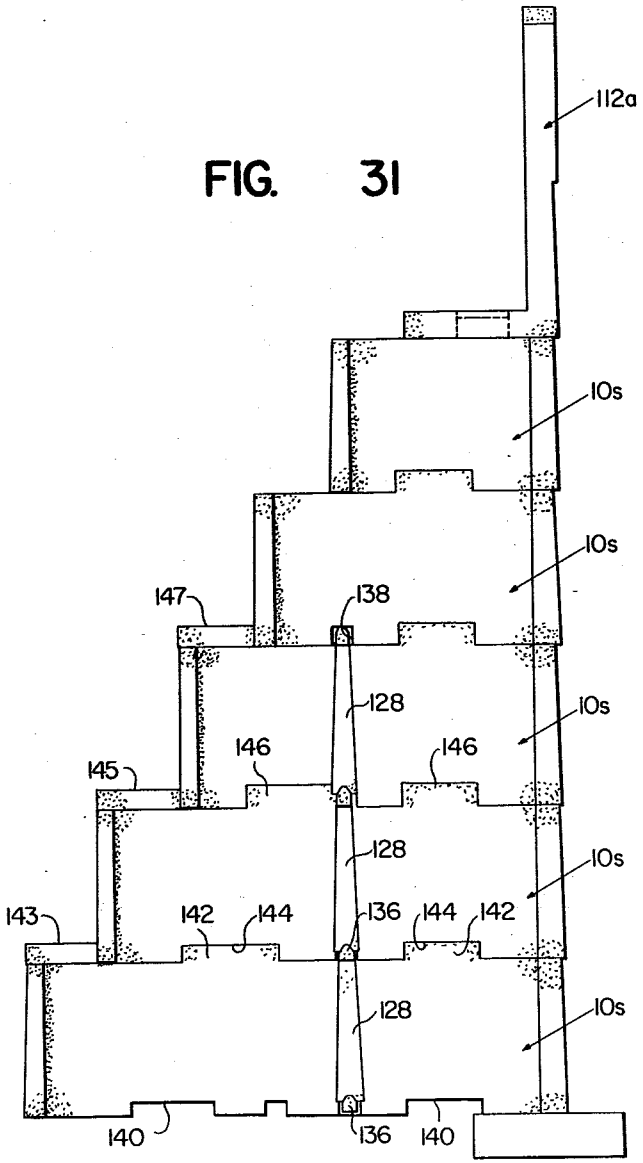
FIG. 31 is a somewhat perspective side elevation of a further composite wall with an L-shaped unit at the top and horizontal closure means associated with several of the lower rows of structural units.
Figure 32:
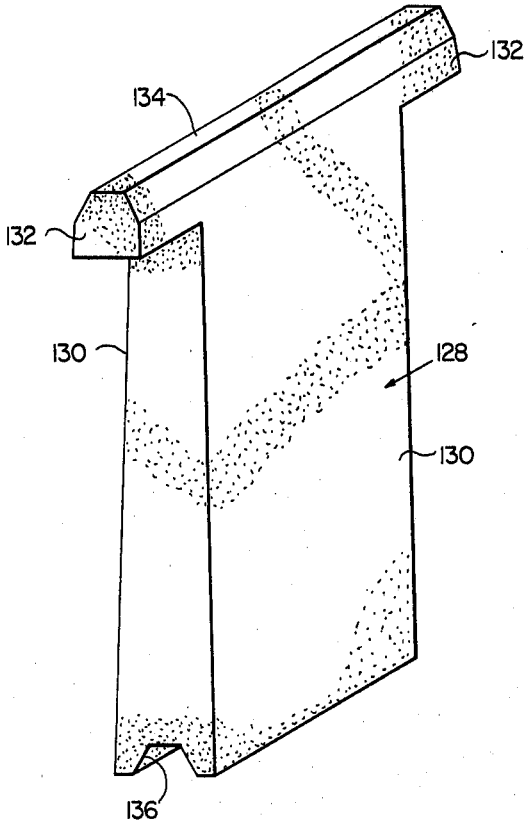
FIG. 32 is a somewhat schematic perspective view of a precast drop-in unit which serves as a partition means.

In FIG. 31 it should also be noted that the arms of the units 10*s*, 10*s* in the two lowermost rows or courses of units are each provided with double mortise-tendon interlock means in spaced relationship along the arms. That is, mortises 140, 140 in the arm of the lowermost unit 10*s* are spaced apart along the length of their arm as are tendons 142, 142. Similarly, mortises 144, 144 in the arm of the structural unit 10*s* shown in the second course are spaced apart along the arm of the unit and tendons 146, 146 at the top of the arm are similarly spaced. With the wider or deeper units 10*s*, 10*s* it is found to be advantageous to include such double mortise-tendon interlocks in spaced relationship and thereby to reduce the amount of reinforcing steel required.

Still further in FIG. 31, an L-shaped unit 112*a* is similar to the above described units 112, 112 but is of somewhat lighter weight construction and may be employed, for example, for purely aesthetic or finishing purposes along a top view or course of a retaining or other wall.

In both FIGS. 30 and 31 it should be noted that horizontal closure means is provided for rear portions of wider structural units exposed behind narrower units thereabove. Thus, as shown in FIG. 30 slab 127 covers the rear portion of the lowermost units 10*s* and in FIG. 31 slabs 143, 145, and 147 are similarly employed for the first three courses of units 10*s*, 10*s*. When the units are used in retaining walls, fill is deposited in the unit cavities and also rearwardly of the units or to the left of the wall in FIGS. 30, 31. Fill atop the closure means such as the slabs 127, 143–147, adds substantially to the hold-down force and enhance the "gravity wall" characteristics of the composite wall. The 80% inclusion of fill effect rises substantially toward 100%.

Figure 33:
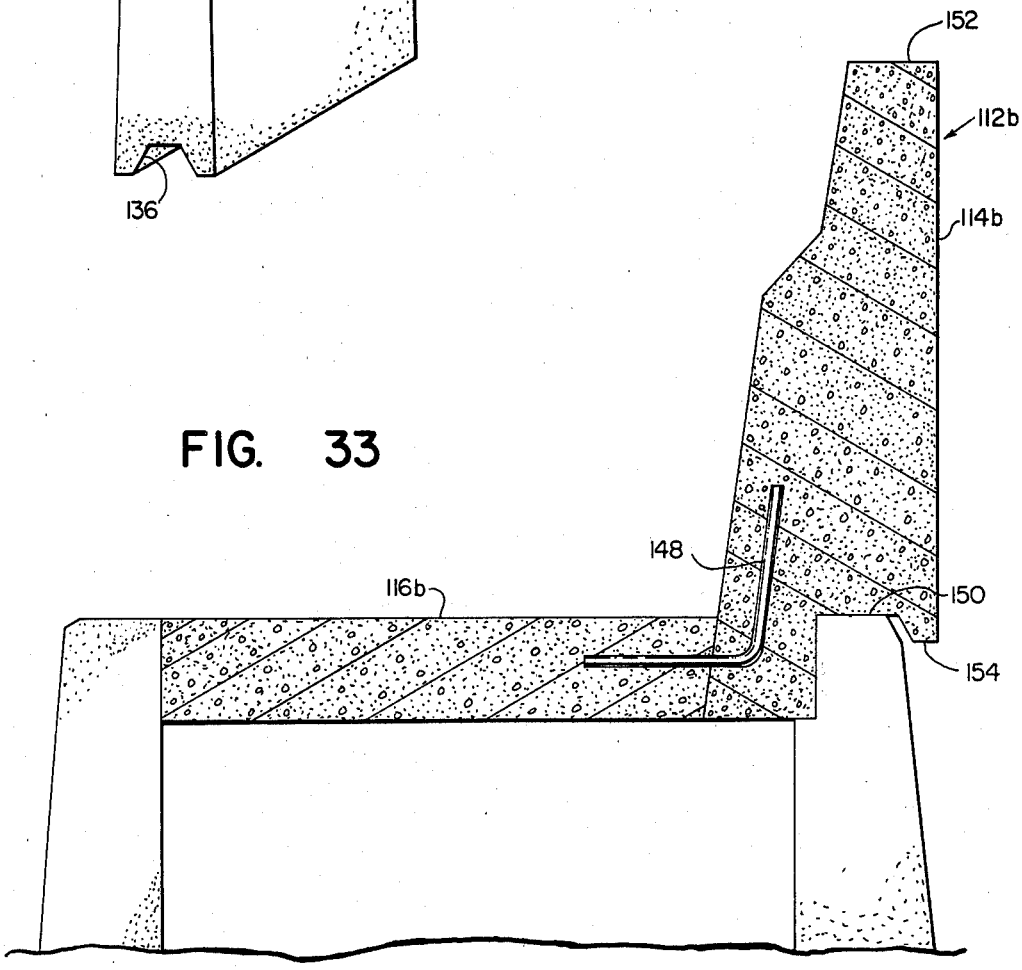
FIG. 33 is a somewhat perspective fragmentary sectional view showing a two-part L-shaped top unit.

In FIG. 33, there is illustrated an L-shaped unit 112*b* which is similar to those described above but which is formed in two parts. More particularly, a vertical arm or part 114*b* is preferably of precast construction and a horizontal part or arm 116*b* is preferably of poured-in-place construction. Further, reinforcing members indicated generally at 148 extend between the two parts or arms at their point of juncture. The precast arm 114*b* may comprise a parapet traffic barrier or the like which may require precise alignment of an upper surface, for example, in relation to a highway grade. As will be apparent, shimming can be accomplished at 150 between the member and the upper surface of a sub-adjacent structural unit such as the units 10*s* above. Still further, in the precast operation, various dimensions may be provided for with relative ease as for example various vertical dimensions and, further, desired inclinations along the top surface 152 of the parapet can be readily achieved in the precast operation. A parapet member 114*b* or a series of such members may be placed in position atop structural units 10*s*, 10*s* with appropriate dimensioning and with shimming where necessary and the poured-in-place portion 116*b* of the L-shaped member may thereafter be provided. Note also that the small overhang 154 will conceal shimming at the area 150.

Figure 33A:
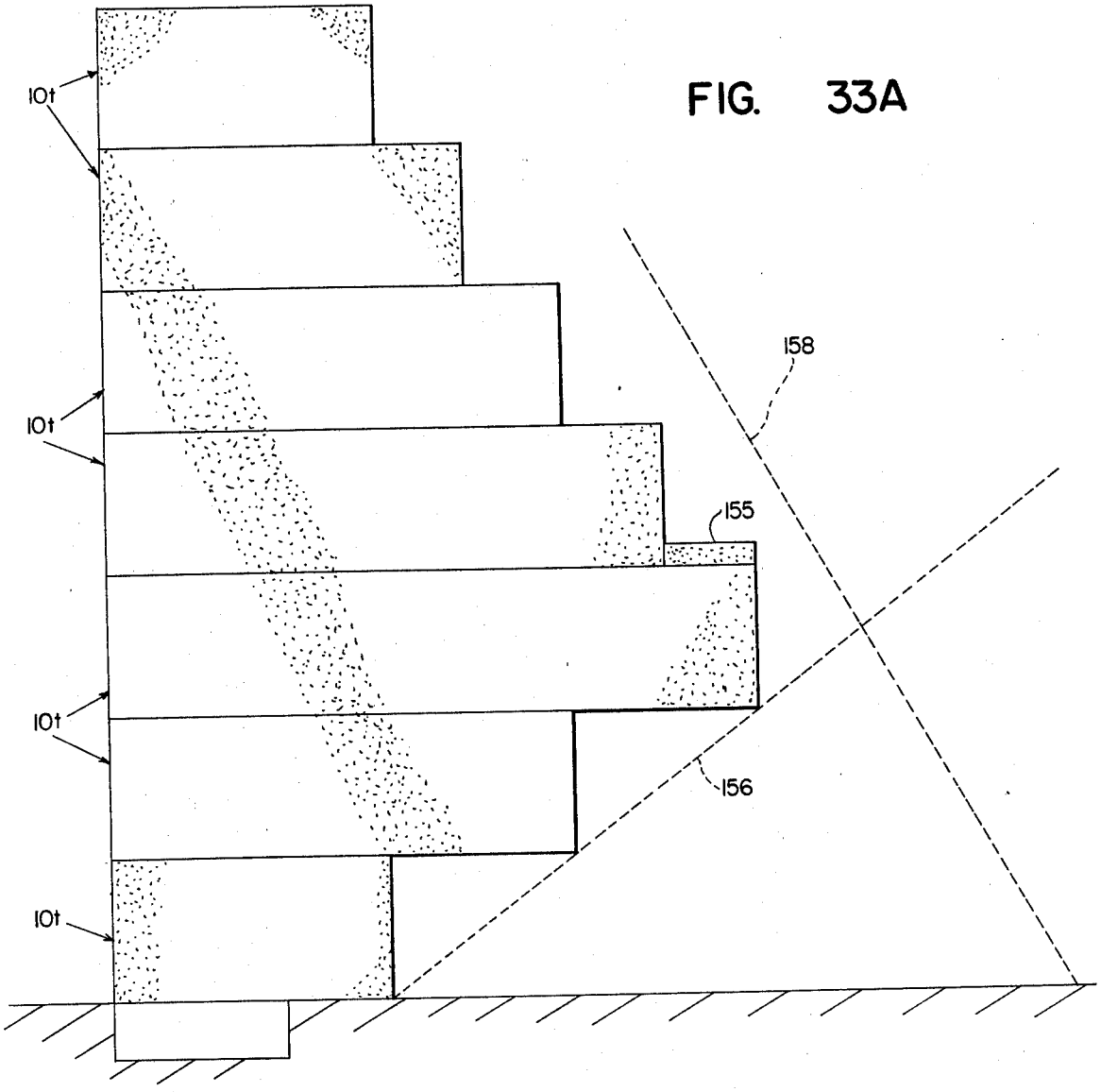
FIG. 33A is a somewhat schematic side elevation view of a further composite wall structure of the narrow-wider-narrower type.

In FIG. 33A a further wall configuration is disclosed wherein horizontal rows of structural units are dimensioned and arranged from the bottom of the wall toward the top in narrower-wider-narrower progression with the front of the wall substantially in a common plane. Thus, units 10*t* may for example comprise a first or lowermost row of units 6 feet wide, a second row 10 feet wide, a third row 14 feet wide with closure means 155, a fourth row of 12 feet wide, a fifth row 10 feet wide, a sixth row 8 feet wide and a seventh row 6 feet wide. As will be apparent the first three rows define at least generally at rear portions a plane shown in broken line and which inclines upwardly and rearwardly with respect to the wall. The plane, indicated generally at 156, may be regarded as an "angle of repose" for the excavated material or, more specifically, the material remaining after excavation. Thus, it has been found that a wall of high degree of strength and integrity can be provided by approximately following the angle of repose and thereafter, in progression upwardly, reversing the procedure and employing smaller or narrower units as the top of the wall is approached. Despite the appearance of the wall, which might be regarded as unstable, no such result ensues when the wall cavities are filled and the wall back filled. Instead, a high degree of stability is achieved and it is believed that the additional rearward extension of the lowermost units as in a wall which progresses from wide to narrow upwardly may in fact be superfluous. The angle of inclination of the plane 156 may vary from one application to another as may the point of reversal i.e. the point at which the wall ceases to become wider in progression upwardly and is reversed to a narrower configuration. These parameters can be calculated for specific applications and the wall constructed accordingly.

The advantages of the FIG. 33A construction will be apparent. As compared with a wall which progresses throughout its height from a wide to narrow configuration, the wall provides for a substantial savings in concrete. Further, it is to be noted that the amount or extent of excavation in preparation for construction of the wall is drastically reduced as is the amount of backfill material. The inclined plane indicated generally by broken line 158 may for example represent an excavation necessary for a wall progressing from wide to narrow when viewed upwardly. Obviously, the degree of undercut is excessive and a great mass of material must be removed to provide a substantially vertical wall extending upwardly from the point of intersection of the plane 158 with the plane at the base of the wall. Thus, substantial savings in excavation and backfill costs are realized with the plane 156 which may obviously be cut generally vertically beyond the point of maximum rearward extent of the retaining wall i.e. adjacent the 14 foot structural unit 10*t*.

Figure 34:
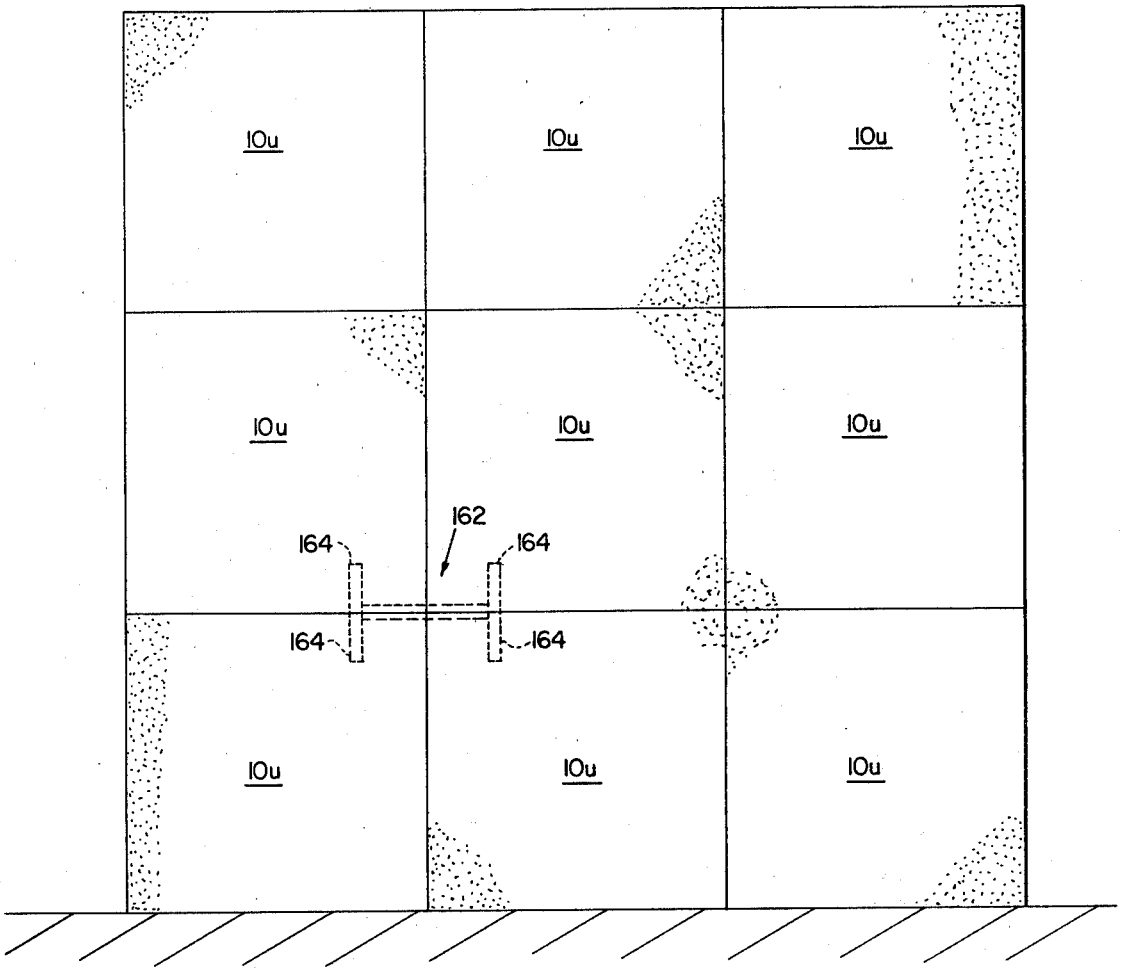
FIG. 34 is a somewhat schematic front view of a further composite wall structure with structural units in vertical alignment and with a horizontal unit connecting means.

In FIG. 34, a composite wall 160 has structural units 10*u*, 10*u* arranged in vertical alignment as opposed to the staggered arrangement above. The units 10*u*, 10*u* may be substantially identical with those described above. Horizontal connecting means are preferred, however, and may taken the form of generally H-shaped rod-like members such as 162 shown in broken line form and having arms 164, 164 entered in suitable openings in the side panels of the units. As will be apparent, four (4) adjacent units may thus be tied together.

Figure 35:
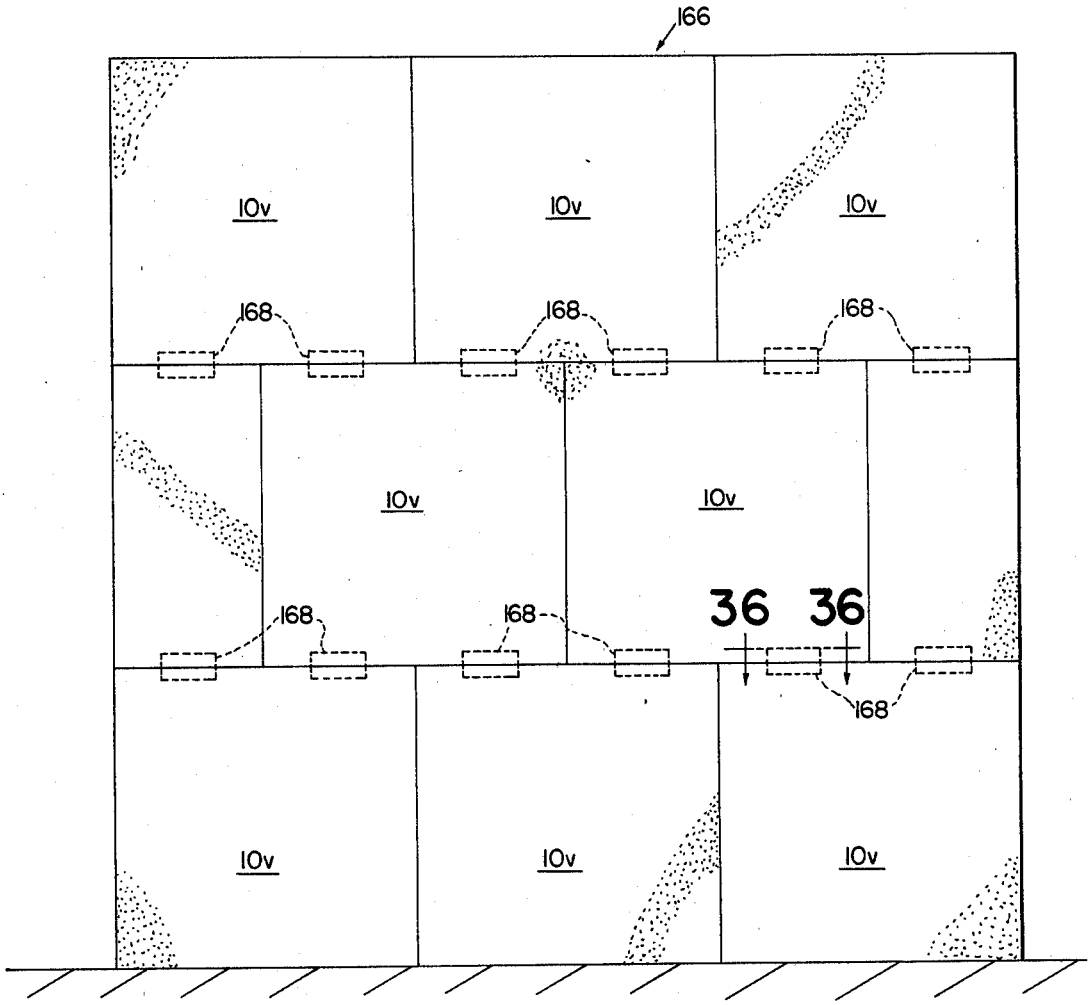
FIG. 35 is a somewhat schematic front view of a further composite wall structure with bearing pads employed to provide a columnar effect.
Figure 36:
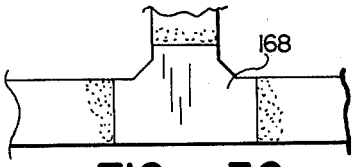
FIG. 36 is a somewhat schematic fragmentary section taken generally as indicated at 36, 36 in FIG. 35.

A staggered wall 166 in FIG. 35 includes structural units 10*v*, 10*v* which may be substantially identical with those described above. Bearing pads 168, 168, FIGS. 35 and 36, and of material such as neoprene rubber, however, have substantial thickness and serve to space vertically adjacent panel and arm surfaces and thereby avoid localized stress areas as from small projecting pieces of aggregate or other surface imperfections. A highly beneficial columnar effect is thus achieved.

Figure 37:
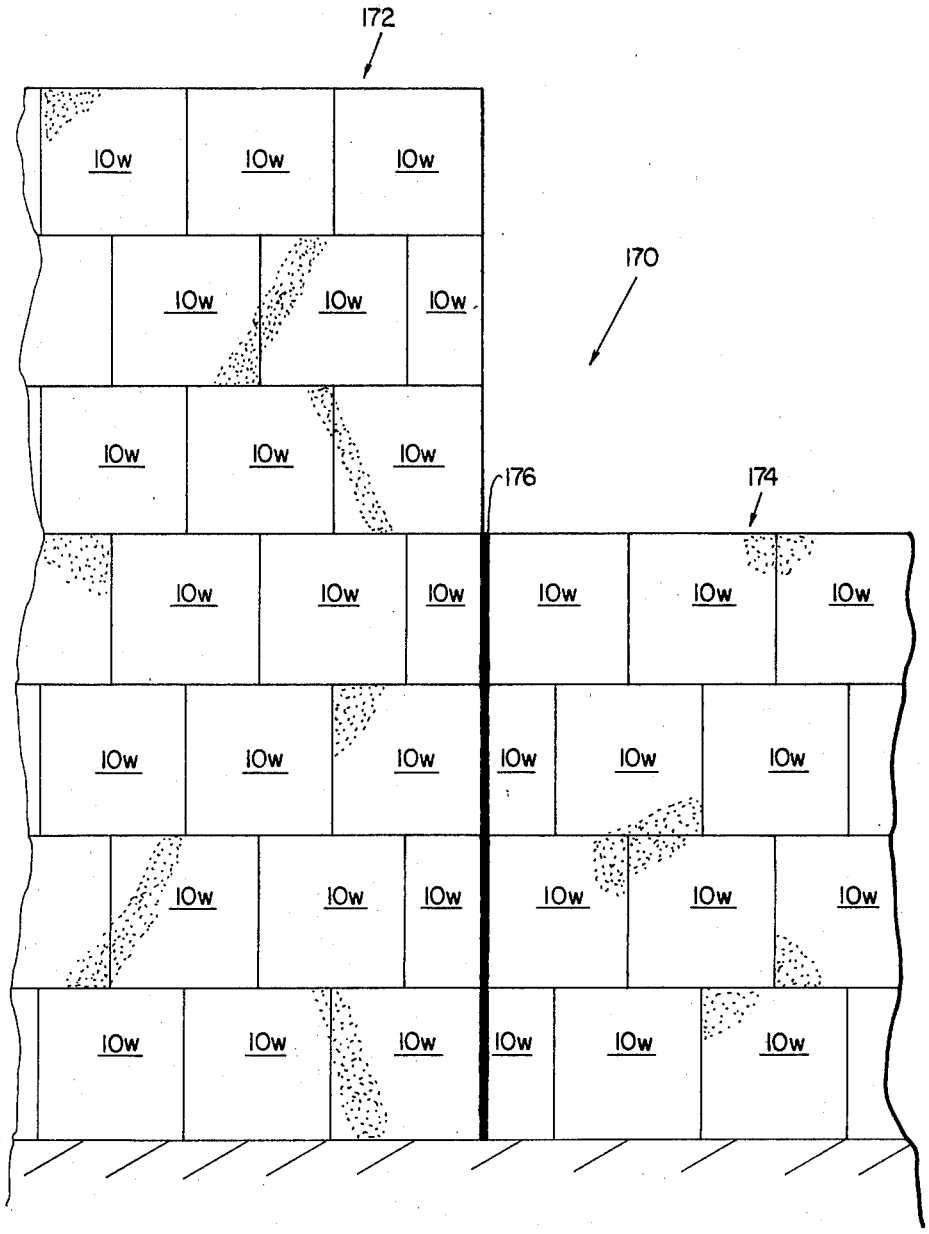
FIG. 37 is a somewhat schematic front view of a further composite wall structure having two sections an a vertical dividing plane.

In FIG. 37, a staggered wall 170 is illustrated in two sections 172 and 174 divided along a vertical plane 176. The wall sections may be of different height with differing settling characteristics or may be of the same height with differing load bearing requirements. In any event division may be readily achieved as desired by providing half units such as 10*w*, 10*w* together with a suitable vertical sealing means 176.

Figure 38:
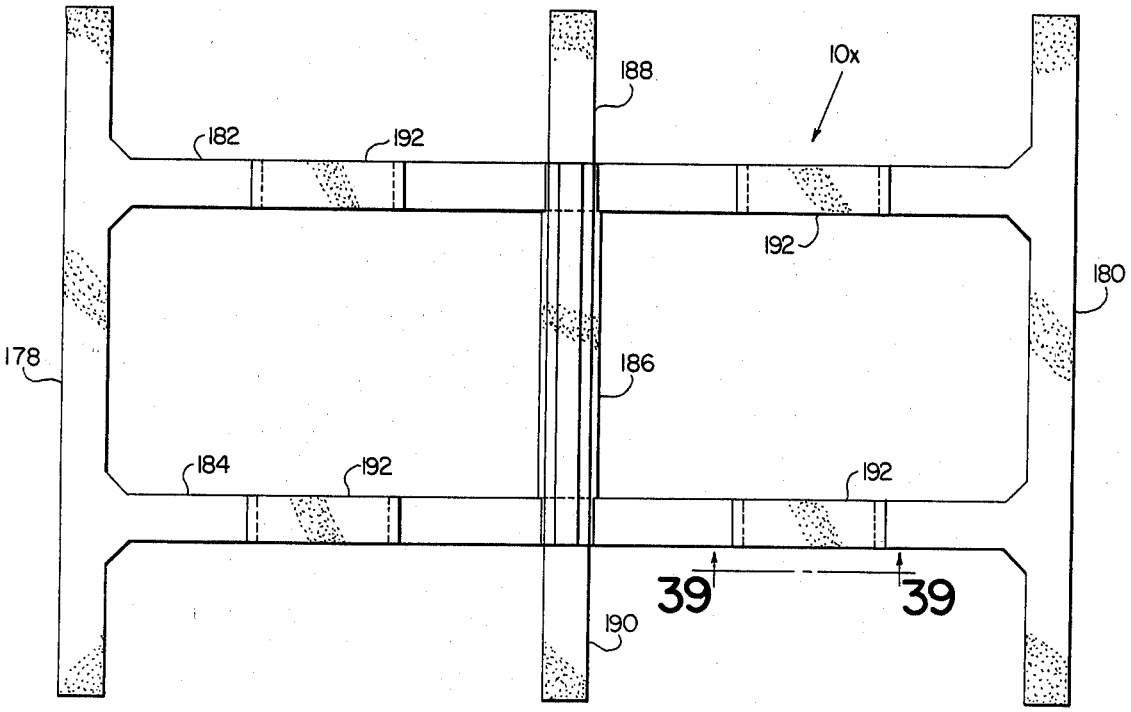
FIG. 38 is a somewhat schematic top view of a further form of a structural unit including a partitioning means and associated partitioning wings together with a dove-tail mortise-tendon construction.
Figure 39:
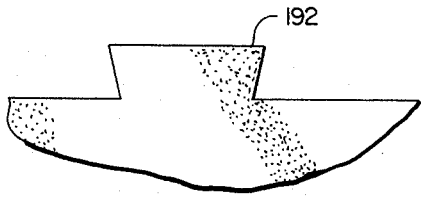
FIG. 39 is a somewhat schematic fragmentary section taken generally as indicated at 39, 39 in FIG. 38 and showing a dove-tail tendon.

FIGS. 38 and 39 show a structural unit 10*x* having side panels 178, 180 and connecting arms 182, 184. A drop-in partition unit 186 of the type described above substantially fits the space between the arms 182, 184 and integral precast wings 188, 190 project outwardly from the arms so as to engage like wings on the arms of horizontally adjacent structural units. As will be apparent, the FIG. 38 construction provides for full partitioning of wall cavities as required. The presently preferred practice contemplates partitioning when the distance between side panels exceeds eight (8) feet.

FIGS. 38 and 39 also illustrates an alternative mortise tendon form wherein a dove-tail connection is provided for. That is, dove-tailed tendons such as 192, best illustrated in FIG. 39, are engaged with complementary dove-tailed mortises, not shown, by relative, horizontal movement of vertically adjacent panels. Unintended or accidental vertical displacement of units is thus positively prevented.

As mentioned above, the improved precast structural units of the present invention provide for substantially increased strength and or superior wall construction. When the units are employed in a retaining wall, a common use, the material retained by the wall at a rear side thereof applies a force to the units in the wall which is felt along force lines angled downwardly and forwardly. In tests of the improved units of the present invention with forces applied angularly to simulate the forces felt in a retaining wall environment, the structural units of the present invention exhibited strength characteristics 100% superior to those of the structural units in the aforementioned patent and in certain instances the strength improvement substantially exceeded 100%. This was achieved with units having substantially less concrete and less than half the steel reinforcement of the patented units.

The improved strength characteristics are believed to derive from the particular type and location of the lateral interlock means of the present invention. That is, the reactive forces on the structural units occur through the connecting arms with the concrete primarily in compression and there are no interengaging lips on the bearing surfaces along the edges of the panels as in the patented structural units mentioned above. Thus, connecting arms and side panels do not tend to separate adjacent their lines of juncture as is found in testing the units disclosed in the patent. Similarly, walls constructed with the units exhibit improvement in strength characteristics and may be raised to heights substantially twice as high as with the patented units.

We claim:

1. A concrete structural unit for use in construction of walls and the like in vertically stacked horizontal row relationship with other similar units; said unit comprising a pair of laterally spaced longitudinally extending and vertically disposed side panels each of a generally rectangular configuration viewed laterally and each of a generally rectangular cross-sectional configuration, and said panels cooperatively defining a vertically exposed generally rectangular space therebetween, a pair of vertically disposed generally rectangular and laterally extending connecting arms disposed between said panels at respective inner surfaces thereof whereby to secure the panels in relatively fixed position, said arms being spaced longitudinally from each other and from the ends of the panels and each of said connecting arms including a top-bottom lateral interlock means comprising a disengageable mortise-tendon connection with a vertically recessed mortise and a complementary vertically projecting tendon arranged in vertically opposite relationship on the arm, said mortise-tendon interlock means including at least two complementary generally vertical bearing surfaces adapted for pressure engagement, and said bottom lateral interlock means on each connecting arm serving cooperatively with top interlock means on a connecting arm of an immediately sub-adjacent unit for laterally interlocking the two units when the units are superimposed, said interlock means being gravity dependent but physically positive laterally with respective generally vertical complementary bearing surfaces of the bottom and top interlock means of the superimposed units in pressure engagement, and each said mortise and tendon having a width less than three-fourths (3/4) the total width of the structural unit whereby said bearing surfaces are spaced substantially laterally inwardly from the side panels toward the center of the connecting arm, and the longitudinal spacing between connecting arms being approximately twice the longitudinal spacing of each arm from the adjacent end of the side panels, the said units thus being adapted for vertical alignment and lateral interlocking of alternate connecting arms when the units are stacked vertically in horizontally staggered rows with the horizontal displacement between units in vertically adjacent rows approximately one-half the length of a unit.

2. A concrete structural unit as set forth in claim 1 wherein said bearing surfaces are inclined slightly from the vertical in a direction upwardly and inwardly toward the lateral center-line of the associated connecting arm.

3. A concrete structural unit as set forth in claim 2 wherein said angle of inclination falls in the range between five degrees (5°) and twenty-five degrees (25°).

4. A concrete structural unit as set forth in claim 1 wherein said bearing surfaces are inclined from the vertical in a direction upwardly and outwardly with respect to the center-line of the associated connecting arm.

5. A concrete structural unit as set forth in claim 1 wherein said mortise and tendon are each approximately centered laterally on the connecting arm.

6. A concrete structural unit as set forth in claim 1 wherein said mortise and tendon are displaced horizontally from the center-line of the associated arm.

7. A concrete structural unit as set forth in claim 1 wherein the mortise and tendon each have a width approximately one third the total width of the structural unit.

8. A concrete structural unit as set forth in claim 1 wherein the mortises are defined at the bottoms of the connecting arms and open downwardly and wherein the tendons are formed integrally at the tops of the connecting arms and project upwardly.

9. A concrete structural unit as set forth in claim 1 wherein each side panel is slightly thicker at the bottom than at the top and includes an integrally formed depending flange along its outer edge, the said flanges overlapping the top surface of a sub-adjacent unit when the units are superposed to provide a shingled effect in the exterior appearance.

10. A concrete structural unit as set forth in claim 9 wherein the lateral dimensions and tolerances between inner edges of the depending flanges are so related to the lateral dimensions and tolerances of the mortises and tendons that the bearing surfaces always engage prior to engagement of a flange with a top edge of a sub-adjacent panel, damage to the flanges being thus avoided.

11. A concrete structural unit as set forth in claim 9 wherein the connecting arms project downwardly below the bottom surfaces of the side panels so that the bottom surfaces of the arms extend below the depending flanges, and wherein the upper portions of the connecting arms adjacent the tendons are recessed to receive said downwardly projecting lower portions of the arms when the units are in stacked relationship.

12. A concrete structural unit as set forth in claim 1 wherein the side panels and connecting arms are formed integrally to provide a unitary monolithic structural unit.

13. A concrete structural unit as set forth in claim 1 wherein the side panels and connecting arms are separate elements, and wherein panel and arm connecting means are provided and serve to secure the panels and arms in assembly and in the arrangement as aforesaid.

14. A concrete structural unit as set forth in claim 13 wherein said panel and arm connecting means takes the form of four (4) discrete connecting means operable respectively at the four (4) panel and connecting arm junctions to secure the panels and arms in assembly.

15. A concrete structural unit as set forth in claim 14 wherein each of said four (4) connecting means comprises interengaging threaded elements respectively associated with the panel and arm at the panel-arm junction.

16. A concrete structural unit as set forth in claim 14 wherein each of said four (4) connecting means comprises a lug-notch vertical interlock with the lug and notch at the panel-arm junction.

17. A concrete structural unit as set forth in claim 16 wherein each of said lug-notch vertical interlocks takes the form of an integral concrete lug on the side panel and an integral complementary notch in the connecting arms at the panel-arm junction.

18. A concrete structural unit as set forth in claim 17 wherein each of said connecting means further comprises an attachment plate secured to the arm and projecting from opposite sides thereof approximately at right angles to the arm side surfaces, and interengaging threaded elements respectively associated with the projecting portions of the plate and the lug on the adjacent panel at the panel-arm junction.

19. A concrete structural unit as set forth in claim 18 wherein said interengaging threaded elements at each panel-arm junction each comprise at least two threaded female inserts in the lug and at least two complementary bolts, the said projecting attachment plate portions having at least two openings for receiving the bolts and which are respectively aligned with the two inserts in the lugs.

20. A concrete structural unit as set forth in claim 19 wherein each said attachment plate is secured across the face of the notch in the arm by means of reinforcing members connected thereto and extending into the body of the arms.

21. A composite wall structure comprising a plurality of concrete structural units arranged in vertically stacked relationship and in horizontally extending rows with vertically adjacent units staggered by one-half the length of a unit; each unit comprising a pair of laterally spaced longitudinally extending and vertically disposed side panels of a generally rectangular configuration viewed laterally and each of a generally rectangular cross-sectional configuration, said panels cooperatively defining a vertically exposed generally rectangular space therebetween, a pair of vertically disposed generally rectangular and laterally extending connecting arms disposed between said panels at respective inner surfaces thereof whereby to secure the panels in relatively fixed position, said arms being spaced longitudinally from each other and from the ends of the panels and each of said connecting arms including a top-bottom lateral interlock means comprising a disengageable mortise-tendon connection with a vertically recessed mortise and a complementary vertically projecting tendon arranged in vertically opposite relationship on the arm, said mortise-tendon interlock means including at least two complementary generally vertical bearing surfaces adapted for pressure engagement, and said bottom lateral interlock means on each connecting arm serving cooperatively with top interlock means on a connecting arm of an immediately sub-adjacent unit for laterally interlocking the two units when the units are superposed, said interlock means being gravity dependent but physically positive laterally with respective generally vertical complementary bearing surfaces of the bottom and top interlock means of the superposed units in pressure engagement, and each said mortise and tendon having a width less than three-fourths (3/4) the total width of the structural unit whereby said bearing surfaces are spaced substantially laterally inwardly from the side panels toward the center of the connecting arm, and the longitudinal spacing between connecting arms being approximately twice the longitudinal spacing of each arm from the adjacent end of the side panels, the said units thus being adapted for vertical alignment and lateral interlocking of alternate connecting arms when the units are stacked vertically as aforesaid in horizontally staggered rows with the horizontal displacement between units in vertically adjacent rows approximately one-half the length of a unit.

22. A composite wall structure as set forth in claim 21 wherein at least one lower horizontal row of structural units is substantially wider than the horizontal rows of units thereabove, the composite wall structure thus having a somewhat wider base portion than its upper portion.

23. A composite wall structure as set forth in claim 22 wherein at least one horizontal row of conversion units is provided, said units having upper portions adapted for lateral interlock with the narrower horizontal row of units immediately thereabove and lower portions thereof adapted for the wider units disposed therebeneath.

24. A composite wall structure as set forth in claim 22 wherein a plurality of horizontal rows of said wider units are provided to form a lower portion of the composite wall structure, and wherein a plurality of vertically extending tie rods are provided for securing together in vertically stacked relationship said wider structural units.

25. A composite wall structure as set forth in claim 24 wherein foundation slab means are provided beneath the lowermost horizontal row of said wider structural units wherein horizontally extending arm beam means are provided above the uppermost horizontal row of said wider units, and wherein said vertically extending tie rods project downwardly through said foundation slab means and upwardly through said horizontal beam and serve to tie the horizontal rows of said wider structural units, the foundation slab means, and the beam means in integral assembly.

26. A composite wall structure as set forth in claim 22 and including top slab means extending along and above the uppermost row of structural units and serving as a bearing means for structure thereabove.

27. A composite wall structure as set forth in claim 26 and including compressible bearing material arranged between said structural units and serving at least in horizontal joints between said units to distribute the loading effect substantially uniformly.

28. A composite wall structure as set forth in claim 21 and including filter material disposed in the joints between said structural units to prevent the leakage of fine fill material from space within the units to the external surface thereof and thereby to prevent staining of said external surface.

29. A composite wall structure as set forth in claim 28 wherein said filter material takes the form of a sponge-like material which is disposed in the joints between units and compressed therewithin to a substantially flat form.

30. A composite wall structure as set forth in claim 29 and including integrally formed trim means associated with said filter material and extending outwardly therefrom in the joint areas between units to the external surfaces of said joint area whereby to cover the lines of juncture between units.

31. A composite wall structure as set forth in claim 21 and including narrow elongated trim means extending along the joint areas between structural units and concealing said joint areas.

32. A composite wall structure as set forth in claim 31 wherein said trim means take substantially a T configuration with the body portion of the T captured between the surface forming the joints between units and the arm portions of the T extending outwardly and exposed externally to cover the joint areas.

33. A composite wall structure as set forth in claim 32 wherein said body portion of the T shaped trim means is generally U shaped and is collapsible when captured between the surface of the structural units at the joint area.

34. A composite wall structure as set forth in claim 32 wherein said body portion of the T shaped trim means is generally V shaped and is collapsible when captured between the surfaces of structural units at the joint area.

35. A composite wall structure as set forth in claim 22 wherein said horizontal rows of units are arranged from the bottom of the wall toward the top generally in a wider to narrower progression; and wherein the units in at least one of said wider horizontal rows of units are provided with vertical partition means parallel to and spaced from the side panels of the units.

36. A composite wall structure as set forth in claim 35 wherein structureal units in said lower and wider horizontal rows of units are provided with double mortise-tendon interlock means in spaced relationship along the arms.

37. A composite wall structure as set forth in claim 35 wherein said vertical partition means take the form of precast drop-in units adapted to substantially fit in the space between arms of the units.

38. A composite wall structure as set forth in claim 37 wherein said drop-in units are generally rectangular and provided with oppositely projecting supporting wings at upper portions for engagement with and vertical support by top surfaces on the arms.

39. A composite wall structure as set forth in claim 21 and including a plurality of like generally L-shaped structural concrete units, said L-shaped units being arranged in a horizontal row atop the uppermost horizontal row of the aforesaid structural units, and said L-shaped units having generally vertically and horizontally projecting arms with the former projecting upwardly from and lying substantially in the plane of one side of the wall.

40. A composite wall structure as set forth in claim 39 wherein said horizontal arms of said generally L-shaped units are provided with mortises for receiving the tendons on the arms of the units of said uppermost horizontal row of structural units.

41. A composite wall structure as set forth in claim 39 wherein said vertical arms of said generally L-shaped units are substantially coplanar with the front of the wall and provided with top surfaces inclined from the horizontal when viewed from the front of the wall.

42. A composite wall structure as set forth in claim 39 wherein said generally L-shaped units comprise at least two parts with the vertical arms forming one part and being of precast construction and the horizontal arms forming another part and being of poured-in-place construction.

43. A composite wall structure as set forth in claim 42 wherein steel reinforcing elements are provided and serve to interconnect said vertical and horizontal arms of said L-shaped units.

44. A composite wall structure as set forth in claim 21 wherein said horizontal rows of structural units are dimensioned and arranged from the bottom of the wall toward the top in a narrower-wider-narrower progression with the front of the wall substantially in a common plane.

45. A composite wall structure as set forth in claim 44 wherein the lower rear portion of the wall in narrower to wider progression generally follows a plane inclined upwardly and rearwardly with respect to the wall and substantially along an angle of repose for an adjacent excavation wall.

46. A composite wall structure comprising a plurality of concrete structural units arranged in vertically stacked relationship and in horizontally extending rows; each unit comprising a pair of laterally spaced longitudinally extending and vertically disposed side panels of a generally rectangular configuration viewed laterally and each of a generally rectangular cross-sectional configuration, said panels cooperatively defining a vertically exposed generally rectangular space therebetween, a pair of vertically disposed generally rectangular and laterally extending connecting arms disposed between said panels at respective inner surfaces thereof whereby to secure the panels in relatively fixed position, said arms being spaced longitudinally from each other and from the ends of the panels and each of said connecting arms including a top-bottom lateral interlock means comprising a disengageable mortise-tendon connection with a vertically recessed mortise and a complementary vertically projecting tendon arranged in vertically opposite relationship on the arm, said mortise-tendon interlock means including at least two complementary generally vertical bearing surfaces adapted for pressure engagement, and said bottom lateral interlock means on each connecting arm serving cooperatively with top interlock means on a connecting arm of an immediately sub-adjacent unit for laterally interlocking the two units when the units are superposed, said interlock means being gravity dependent but physically positive laterally with respective generally vertical complementary bearing surfaces of the bottom and top interlock means of the superposed units in pressure engagement, and said mortise and tendon interlock means having said complementary bearing surfaces spaced substantially laterally inwardly from the side panels toward the center of the connecting arm, and the longitudinal spacing between connecting arms being approximately twice the longitudinal spacing of each arm from the adjacent end of the side panels, the said units thus being adapted for vertical alignment and lateral interlocking of connecting arms both when units are stacked vertically in horizontal rows in vertical alignment and when the horizontal displacement between units in vertically adjacent rows is approximately one-half the length of a unit.

47. A composite wall structure as set forth in claim 46 wherein at least one lower horizontal row of structural units is substantially wider than the horizontal rows of units thereabove, the composite wall structure thus having a somewhat wider base portion than its upper portion.

48. A composite wall structure as set forth in claim 47 wherein a horizontal row of wider units has an upwardly exposed rear portion behind a narrower row of units thereabove, and wherein said row of wider units includes horizontal closure means at its exposed rear portion for hold-down engagement by fill disposed thereabove.

49. A composite wall structure as set forth in claim 46 and including bearing pads arranged between said structural units and in the areas of the arm-panel junctions at least at the front of the wall, said pads serving to vertically space the units and to provide a columnar effect.

50. A composite wall structure as set forth in claim 46 wherein structural units in at least one of said horizontal rows of units are provided with vertical partition means parallel to and spaced from the side panels of the units for an improved holddown effect by fill deposited within the wall.

51. A composite wall structure as set forth in claim 50 wherein said vertical partition means takes the form of generally inverted V-shaped precast drop-in units adapted to substantially fit in the space between arms of individual units and precast wings projecting outwardly from the arms and engaging like wings on the arms of the horizontally adjacent units.

52. A composite wall structure as set forth in claim 46 wherein structural units in at least one of said horizontal rows are wider than those thereabove and are provided with double mortise-tendon interlock means in spaced relationship along the arms.

53. A composite wall structure as set forth in claim 46 and including a plurality of like generally L-shaped structural concrete units, said L-shaped units being arranged in a horizontal row atop the uppermost row of the aforesaid structural units, and said L-shaped units having generally vertically and horizontally projecting arms with the former projecting upwardly from and lying substantially in the plane of one side of the wall.

54. A composite wall structure as set forth in claim 46 wherein said horizontal rows of structural units are dimensioned and arranged from the bottom of the wall toward the top in a narrower-wider-narrower progression with the front of the wall substantially in a common plane.

55. A composite wall structure as set forth in claim 54 wherein the lower rear portion of the wall in narrower to wider progression generally follows a plane inclined upwardly and rearwardly with respect to the wall and substantially along an angle of repose for an adjacent excavation wall.

56. A composite wall structure as set forth in claim 55 wherein at least one horizontal row of wider units has an upwardly exposed rear portion behind a narrower row of units thereabove, and wherein said row of wider units includes horizontal closure means at its exposed rear portion for hold-down engagement by fill disposed thereabove.

57. A composite wall structure as set forth in claim 46 wherein said structural units are arranged in vertical alignment, and wherein horizontal connecting means are provided between horizontally adjacent units.

58. A composite wall structure as set forth in claim 46 wherein said structural units are arranged in horizontally staggered rows with the horizontal displacement between units in vertically adjacent rows approximately one-half the length of a unit.

59. A composite wall structure as set forth in claim 58 wherein the wall is divided along a vertical plane into at least two sections, wherein half units are employed to effect division along the vertical plane, and wherein sealing means is disposed vertically between the wall sections.

* * * * *